US010842298B2

(12) United States Patent
Huff et al.

(10) Patent No.: US 10,842,298 B2
(45) Date of Patent: Nov. 24, 2020

(54) FRAME APPARATUS

(71) Applicant: MCS Industries, Inc., Easton, PA (US)

(72) Inventors: Brad William Huff, Nazareth, PA (US); Matthew Scott Kressin, Allentown, PA (US); Weisha Yu, Belvidere, NJ (US)

(73) Assignee: MCS INDUSTRIES, INC., Easton, PA (US)

( * ) Notice: Subject to any disclaimer, the term of this patent is extended or adjusted under 35 U.S.C. 154(b) by 0 days.

(21) Appl. No.: 16/454,320

(22) Filed: Jun. 27, 2019

(65) Prior Publication Data

US 2019/0313814 A1 Oct. 17, 2019

Related U.S. Application Data

(63) Continuation of application No. 15/948,025, filed on Apr. 9, 2018, now Pat. No. 10,376,077, which is a continuation of application No. 15/155,984, filed on May 16, 2016, now Pat. No. 9,962,018.

(60) Provisional application No. 62/200,184, filed on Aug. 3, 2015.

(51) Int. Cl.
*A47G 1/06* (2006.01)

(52) U.S. Cl.
CPC ..... *A47G 1/06* (2013.01); *A47G 1/0605* (2013.01); *A47G 2001/0677* (2013.01)

(58) Field of Classification Search
CPC . A47G 1/06; A47G 1/0605; A47G 2001/0677
See application file for complete search history.

(56) References Cited

U.S. PATENT DOCUMENTS 1,358,988 A * 11/1920 Rindsberger ..... A47G 1/06 40/790
2,777,232 A * 1/1957 Kulicke ..... A47G 1/0611 40/780
2,806,309 A 9/1957 Goldberg
3,579,886 A 5/1971 Hughes
3,665,628 A 5/1972 Dammond
(Continued)

FOREIGN PATENT DOCUMENTS

DE 1927833 12/1970
FR 2707150 1/1995
(Continued)

OTHER PUBLICATIONS

Klingenberg, Rena, Wire Line Art Pendant (Tutorial), Jewelry Making Journal, 2016.

*Primary Examiner* — Cassandra Davis
(74) *Attorney, Agent, or Firm* — Belles Katz LLC

(57) ABSTRACT

A frame apparatus for displaying a flat article and a combined frame apparatus and flat article. In one aspect, the frame apparatus includes an annular display frame defining a rabbet, a stack positioned in the rabbet, and a spacer assembly. The rabbet is defined by a floor and a wall, the wall including a channel. The spacer assembly may have a rigid portion and a compressible portion. The spacer assembly is positioned in the rabbet with the compressible portion of the spacer assembly extending into the channel in the wall to couple the spacer assembly to the annular display frame. The spacer assembly may also be in contact with the stack to hold the stack in the rabbet.

20 Claims, 43 Drawing Sheets

(56) References Cited

U.S. PATENT DOCUMENTS

| | | | | |
|---|---|---|---|---|
| 3,811,214 | A | 5/1974 | Tate | |
| 3,865,342 | A * | 2/1975 | Kanzelberger | A47G 1/143 248/470 |
| 4,583,309 | A * | 4/1986 | Kane | A47G 1/0655 40/711 |
| 4,850,125 | A | 7/1989 | Green | |
| 4,949,483 | A | 8/1990 | Dobson et al. | |
| 5,012,601 | A | 5/1991 | Garland et al. | |
| 5,125,175 | A * | 6/1992 | Huff, Jr. | G09F 1/12 40/718 |
| 5,524,370 | A * | 6/1996 | Roy | A47G 1/06 40/748 |
| 6,354,031 | B1 * | 3/2002 | Meur | G09F 1/12 40/781 |
| 6,742,296 | B2 * | 6/2004 | Johnson | A47G 1/06 40/790 |
| 7,069,682 | B2 | 7/2006 | Gatt et al. | |
| 2003/0226302 | A1 | 12/2003 | Flodin et al. | |
| 2013/0180142 | A1 | 7/2013 | Kressin et al. | |

FOREIGN PATENT DOCUMENTS

| | | |
|---|---|---|
| FR | 2828081 | 2/2003 |
| GB | 2114884 | 9/1983 |

* cited by examiner

FRAME APPARATUS

CROSS-REFERENCE TO RELATED PATENT APPLICATIONS

The present application is a continuation of U.S. patent application Ser. No. 15/948,025, filed Apr. 9, 2018, which is a continuation of U.S. patent application Ser. No. 15/155,984, filed May 16, 2016, now issued as U.S. Pat. No. 9,962,018, which claims the benefit of U.S. Provisional Patent Application Ser. No. 62/200,184, filed Aug. 3, 2015, the entireties of which are hereby incorporated herein by reference.

FIELD OF THE INVENTION

The present invention relates generally to frames, and specifically to a frame apparatus for displaying an article.

BACKGROUND OF THE INVENTION

People often like to commemorate their achievements by framing diplomas and medals. Furthermore, people enjoy framing photographs, posters and other types of photographic media for display on the wall in their homes. People also frame certain types of memorabilia in order to display the memorabilia and protect it against damage that may occur over time as a result of the memorabilia being exposed to the ambient environment.

There are many different types of frames that currently exist for the purpose of displaying the item retained within the frame and protecting the item against damage. Frames come in a wide variety of sizes, colors, textures and finishes. Furthermore, frames can be used with matting that surrounds a smaller photo or item to enhance the aesthetics of the framed photo or item. Alternately, frames may be constructed such that they have transparent front and rear glazings. This permits a framed photo or item to appear as if it is floating within the frame.

One problem with existing frames is that they generally require a backing and additional mounting clips to retain the backing in the frame. Multiple clips are usually required to adequately secure the backing. These clips require assembly, add manufacturing cost, and are frequently prone to breakage. A simpler frame apparatus that has fewer components, is easier to assemble, and is more robust is therefore desired.

SUMMARY OF THE INVENTION

Exemplary embodiments according to the present disclosure are directed to a frame apparatus for displaying an article, the frame apparatus comprising an annular display frame having an inner surface defining a display opening, the annular display frame comprising a rabbet defined by a floor and a wall of the annular frame, the wall of the rabbet comprising a first engagement portion and a second engagement portion. The frame apparatus further comprises a transparent front panel positioned in the rabbet that encloses the display opening, a rear panel positioned in the rabbet in a stack with the transparent front panel, and an annular spacer frame having an inner surface defining a central opening, the annular spacer frame positioned in the rabbet. The first and second engagement portions engage the annular spacer frame to lock the annular spacer frame and the stack in the rabbet.

In one aspect, the invention can be a frame apparatus that includes an annular display frame defining a rabbet, a stack positioned in the rabbet, and a spacer assembly. The rabbet is defined by a floor and a wall, the wall including a channel. The spacer assembly may have a rigid portion and a compressible portion. The spacer assembly is positioned in the rabbet with the compressible portion of the spacer assembly extending into the channel in the wall to couple the spacer assembly to the annular display frame. The spacer assembly may also be in contact with the stack to hold the stack in the rabbet.

In another aspect, the invention can be a frame apparatus for displaying an article, the frame apparatus comprising: an annular display frame having an inner surface defining a display opening, the annular display frame comprising: a rabbet defined by a floor and a wall of the annular display frame; and a channel formed into the wall; a stack positioned in the rabbet; and a plurality of spacer bars positioned in the rabbet, each of the spacer bars comprising a rigid portion and a compressible portion, the compressible portion extending into the channel in the wall of the rabbet to couple the spacer bars to the annular display frame and hold the stack in the rabbet.

In yet another aspect, the invention can be a frame apparatus for displaying an article, the frame apparatus comprising: an annular display frame having an inner surface defining a display opening, the annular display frame comprising: a rabbet defined by a floor and a wall of the annular display frame; and a channel formed into the wall; a stack positioned in the rabbet; and a spacer assembly positioned in the rabbet in contact with the stack, the spacer assembly comprising a rigid portion and a compressible portion, the compressible portion extending into the channel in the wall of the rabbet to couple the spacer assembly to the annular display frame and hold the stack in the rabbet.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The following detailed description of the exemplary embodiments will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
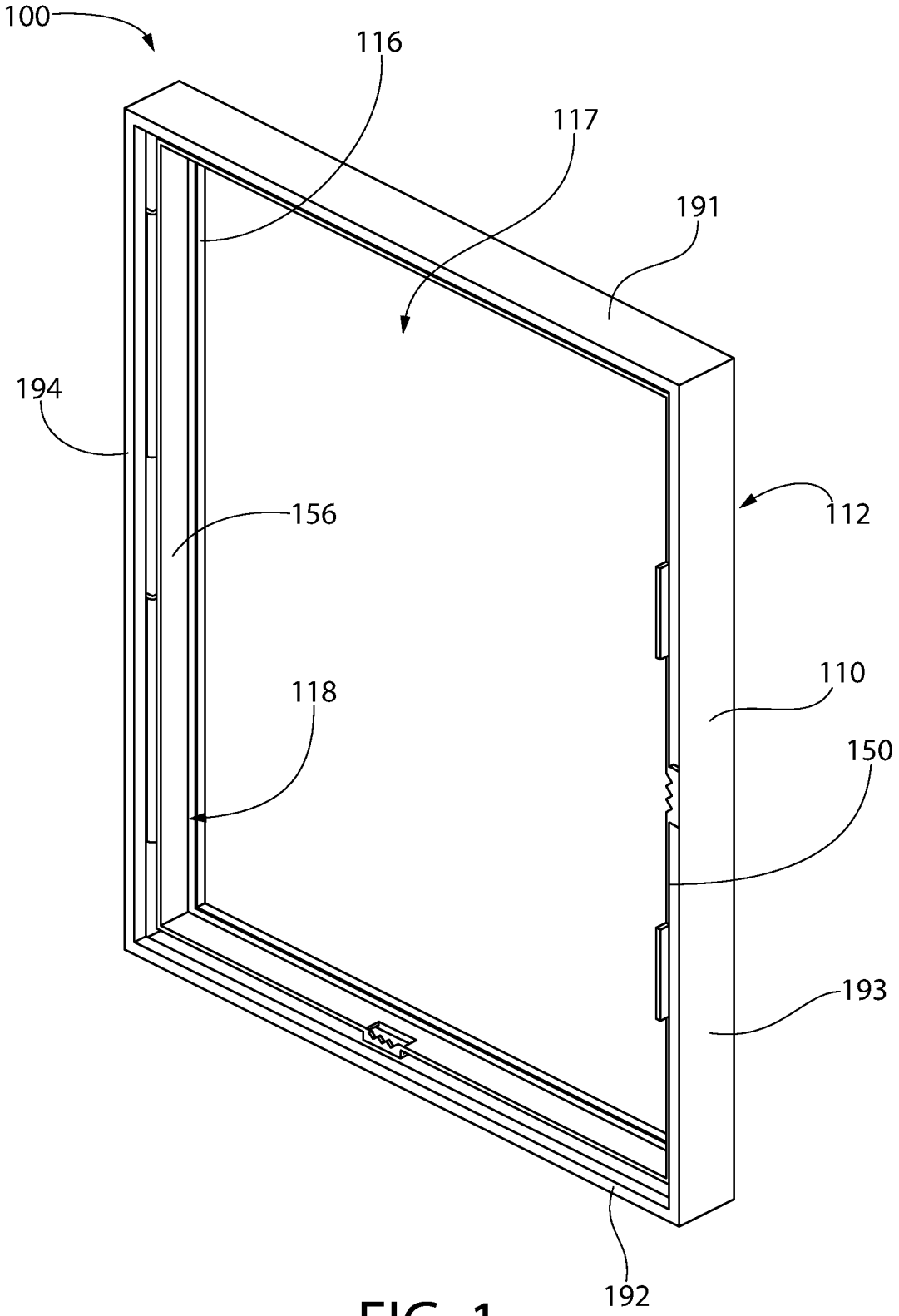
FIG. 1 is a rear perspective view of a frame apparatus in accordance with an embodiment of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

Figure 2:
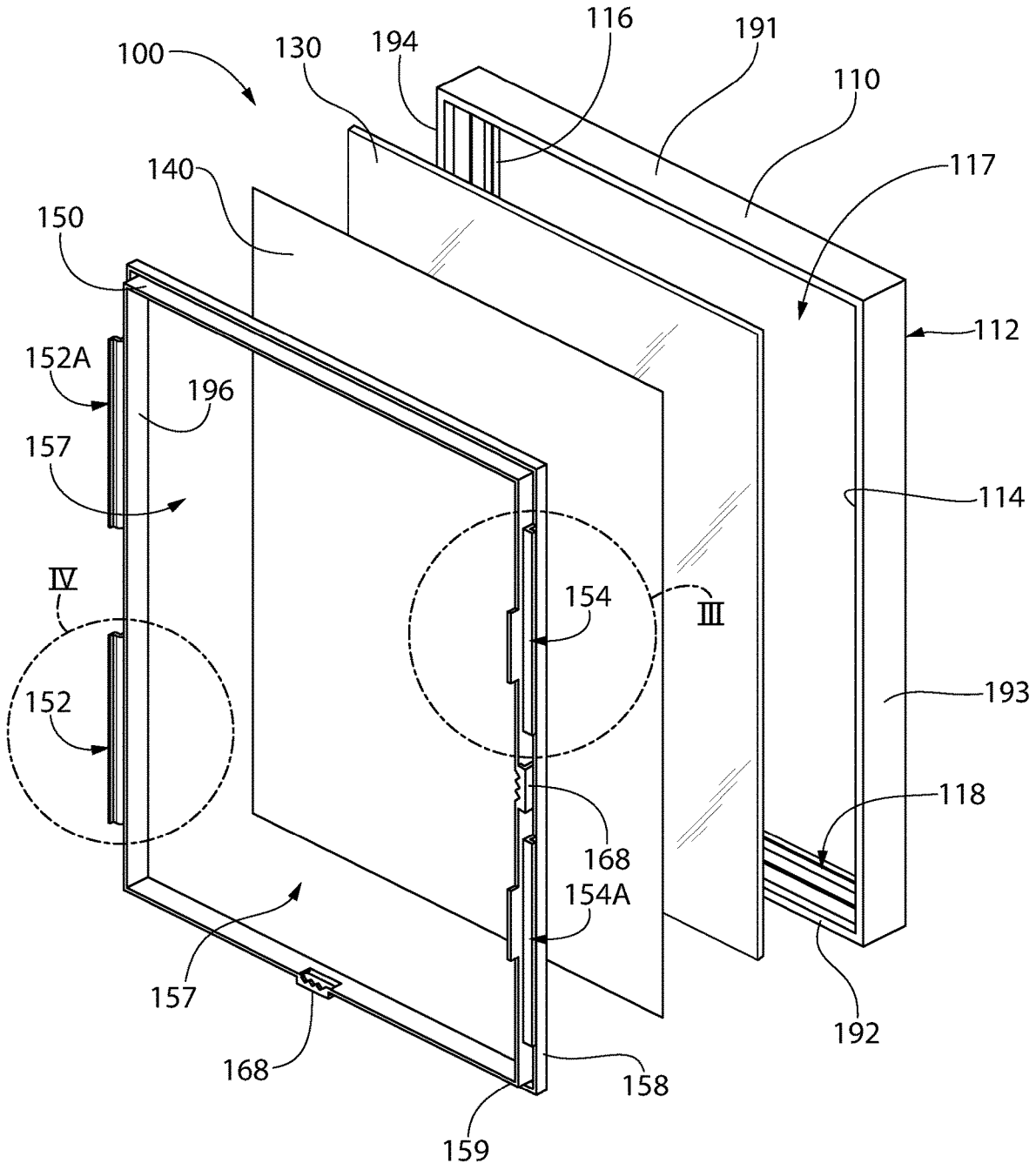
FIG. 2 is an exploded view of the frame apparatus of FIG. 1.

Referring to FIG. 1, a rear perspective view of a frame apparatus 100 according to a first embodiment of the invention. The exemplary embodiment may be a so-called "float frame" or may be a conventional picture frame. As best shown in FIG. 2, the exemplary embodiment comprises an annular display frame 110, a transparent front panel 130, a rear panel 140, and an annular spacer frame 150. A display article, such as a photograph, a piece of paper, a poster, a sports jersey, or another article that is sought to be displayed, may be placed between the transparent front panel 130 and the rear panel 140. As will be described in greater detail below, the annular spacer frame 150 engages the annular display frame 110 and applies pressure to the rear panel 140, forcing the rear panel against the transparent front panel 130, which is in turn forced against the annular display frame 110 such that a display article may be captured between the transparent front panel 130 and the rear panel 140. The combination of the transparent front panel 130 and the rear panel 140 forms a stack. The stack need not be limited to a single transparent front panel 130 and a single rear panel 140, but may also include additional panels. Thus, it is possible to create an embodiment where there are three or more layers in the stack.

In the preferred embodiment, the transparent front panel 130 is clear. The transparent front panel 130 may be composed of any material, but is most preferably made of glass, polystyrene, acrylic, plexiglass, polycarbonate, or any other clear material suitable for framing purposes. The rear panel 140 may also be made of glass, polystyrene, acrylic, plexiglass, polycarbonate, or any other clear material suitable for framing purposes. In yet other embodiments, the rear panel 140 may be made of an opaque material such as cardboard, cellulosic fiberboard, PVC, aluminum, or other materials known in the art. The rear panel 140 need not be clear, and may be either clear or transparent, depending on the desired end product. In the event that the rear panel 140 is not desired to be clear, it may also be translucent or painted or finished with other materials such as paint or felt so that a pleasing texture is achieved. If desired, more than two panels may be used as discussed above. It is conceived that three or more panels may be used, and any of them may be transparent, translucent, or opaque. Thus, it is within the scope of the invention to have both the transparent front panel 130 and the rear panel 140 be formed of a transparent material and interpose one or more additional transparent, translucent, or opaque layers between the transparent front panel 130 and the rear panel 140.

As will be discussed in greater detail below, the annular display frame 110 may be constructed from extrusions of aluminum, PVC, steel, or other materials capable of providing a rigid profile and an aesthetically pleasing outward appearance. Generally the annular display frame 110 is rectangular, but in some embodiments, it may be formed as a square, and all four segments would be of equal length. The annular display frame 110 is formed of four segments, each segment being an extruded component having an identical cross-sectional profile. The annular display frame 110 is formed with two short segments 191, 192 and two long segments 193, 194. These four segments 191-194 form a closed perimeter. The segments 191-194 are cut such that each corner has a 45 degree miter or are cut at 90 degrees and one length is butted against the other. Other ways of forming the ends of the segments are also conceived of, as would be apparent to one of skill in the art. The lengths of material may be joined by a corner bracket, which is preferably made of stamped steel and dimensioned such that the corner bracket fits within the extruded profile of the lengths of material. The corner bracket engages two adjacent lengths of material, forming a finished edge without gaps. In alternate embodiments the corner brackets may be made of plastic, aluminum, or the like. In yet other embodiments, such as those discussed in greater detail below, the frame may be formed as a single piece, or may be constructed of wood, medium-density fiberboard (MDF), plastic, or other materials and joined using nails, screws, staples, adhesive, welding, molding, or the like. These embodiments do not require corner brackets. Other processes may be used to form the annular display frame 110, as would be apparent to one of skill in the art. In certain other embodiments the annular display frame 110 may be an oval, a polygon, or any other shape desired.

The annular display frame 110 generally comprises a front surface 112 and a rear surface 114. The front surface 112 is the surface of the annular display frame 110 that is typically visible to a user while the frame apparatus 100 is hanging from a wall or other surface. The rear surface 114 abuts the wall or other surface when the frame apparatus 100 is made to hang therefrom. The annular display frame 110 also has an inner surface 116 which defines a display opening 117. The inner surface 116 extends in a direction substantially perpendicular to the front surface 112, but may also be at an angle such that the inner surface 116 has either an inward or outward taper when viewed from the front surface 112 of the annular display frame 110. This may be used to enhance the aesthetic appeal of the frame apparatus 100. The inner surface 116 is adjacent to a rabbet 118 which is defined by a floor 120 and a wall 122 of the annular display frame 110. The rabbet 118 is formed so that the transparent front panel 130 will fit within the rabbet 118 but can only be removed from the rear surface 114 of the annular display frame 110. This provides a pleasing aesthetic appearance when viewed from the front surface 112 and prevents unintended removal of the transparent front panel 130. In yet other embodiments, the inner surface 116 need not be one formed of planes, but instead may consist of castellations, fingers, curves, or any other geometry. This may be desirable to produce an ornamental appearance that is more ornate or fanciful to enhance consumer appeal.

The display opening 117 formed by the inner surface 116 of the annular display frame 110 may be divided into separate display areas by one or more ornamental dividers, which are not shown in the present embodiment. One ornamental divider may be used to provide two separate display areas, or a pair of intersecting ornamental dividers may be used to divide the display opening 117 into four separate display areas. Other configurations would be apparent to one of skill in the art.

Figure 5:
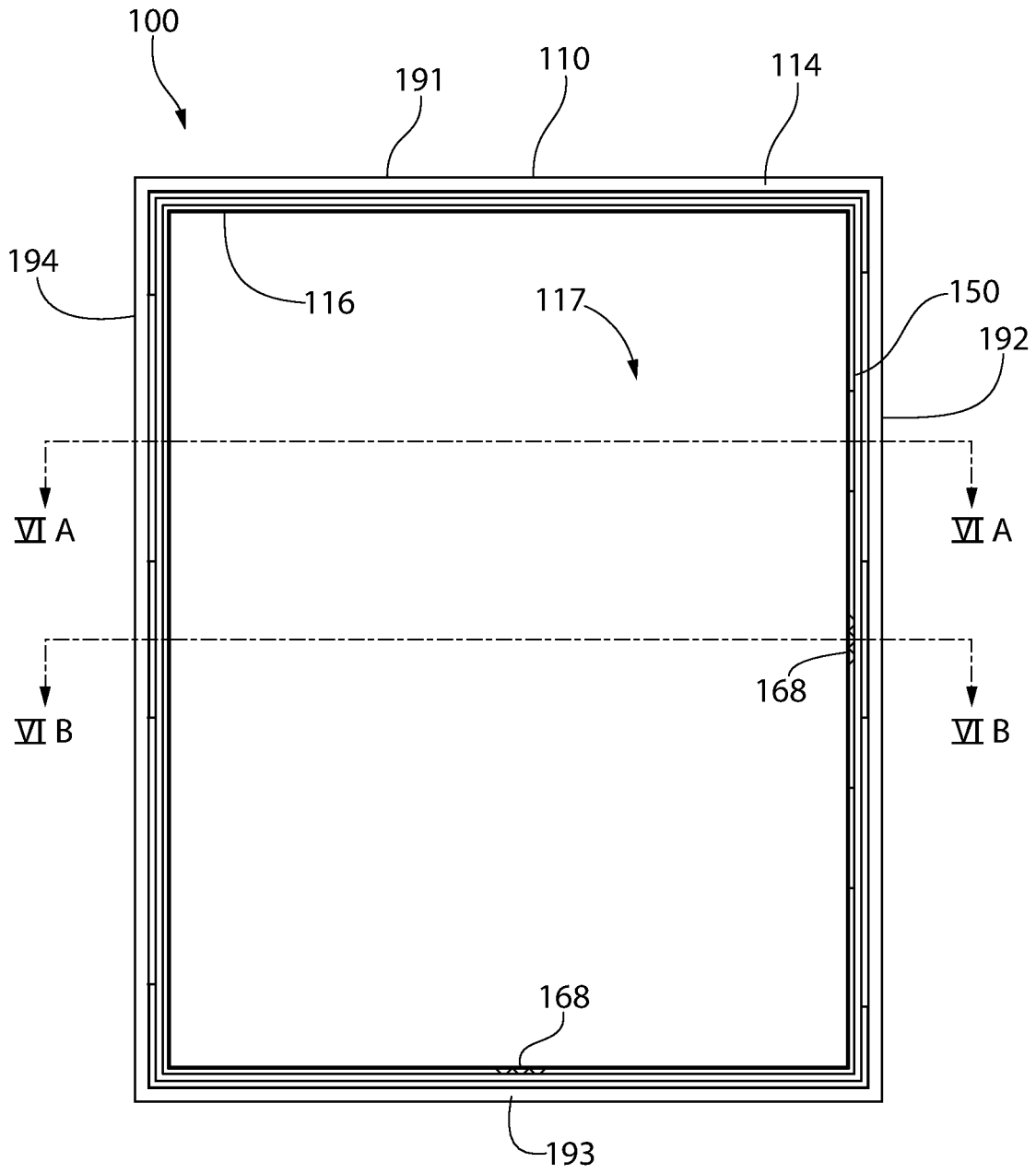
FIG. 5 is a rear view of the frame apparatus of FIG. 1.
Figure 6A:
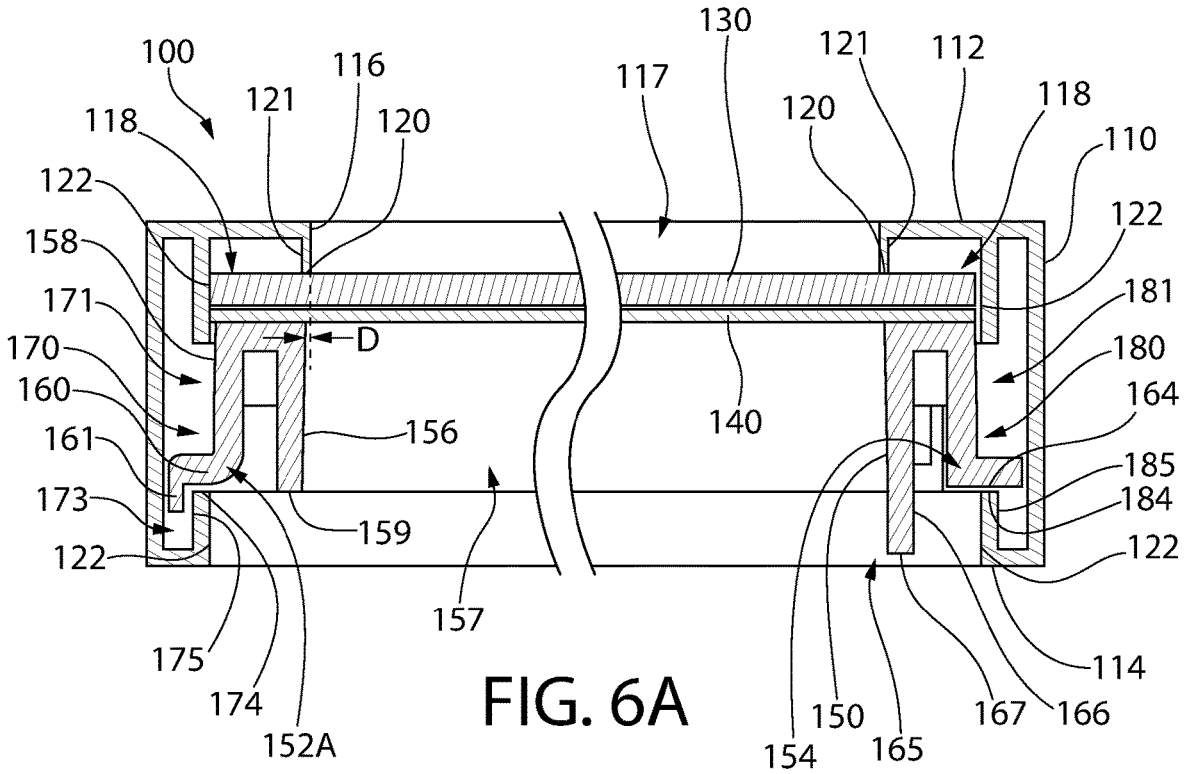
FIG. 6A is a cross-sectional view taken along line VI A-VI A of FIG. 5.
Figure 6B:
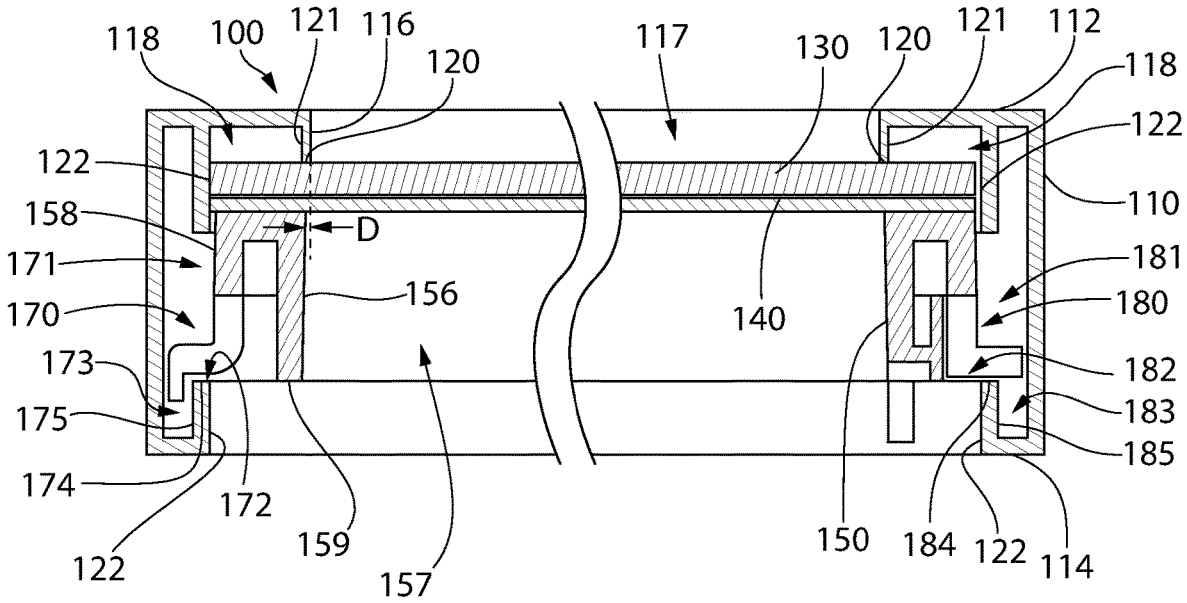
FIG. 6B is a cross-sectional view taken along line VI B-VI B of FIG. 5.

FIG. 5 shows a rear view of the first embodiment of the frame apparatus 100. FIGS. 6A and 6B show cross-sectional views which more clearly show the features of the rabbet 118 of the annular display frame 110. As can be seen in FIGS. 6A and 6B, the inner surface 116 is located inward from the periphery of the annular display frame 110, and the floor 120 is formed in a plane parallel with the front surface 112 of the annular display frame 110. In the present embodiment, the floor 120 is formed by the extrusion of the annular display frame 110. The extrusion profile of the annular display frame 110 has an upturned lip 121 which serves as the floor 120. However, in alternate embodiments, the floor 120 may be formed as a flat surface instead of having the upturned lip 121. Any structure suitable for providing planar contact with the transparent front panel 130 can serve as a floor 120.

Surrounding the floor 120 is a wall 122. The wall 122 is generally perpendicular to the front surface 112 such that it forms the rabbet 118 and contains the transparent panel 130 such that the transparent panel 130 drops into the rabbet 118 and prevents significant in-plane motion of the transparent panel 130. Thus, the transparent panel 130 can only be moved a small distance in a plane parallel with the front surface 112. The wall 122 need not be a continuous surface, and need only contain the transparent panel 130 within the annular display frame 110.

The wall 122 of the rabbet 118 has a first engagement portion 170 and a second engagement portion 180 to retain the annular spacer frame 150. In the present embodiment, the engagement portions 170, 180 are formed as first and second grooves 171, 181 which are formed into the wall 122. The first groove 171 has a first entry section 172 and a first receiving section 173. The first entry section 172 extends generally parallel with the front surface 112 of the annular display frame 110, while the first receiving section 173 extends generally perpendicular to the front surface 112. The first entry section 172 may extend at an angle to the front surface 112, but may not be perpendicular to the front surface 112. Similarly, the first receiving section 173 may extend at an angle other than perpendicular to the front surface 112, but may not be parallel to the front surface 112. The engagement portions 170, 180 extend along the entirety of the length of their respective segments. However, in alternate embodiments the engagement portions 170, 180 may only be formed along part of the length of their respective segments.

The first entry section 172 has a first engagement surface 174 facing toward the floor 120 of the rabbet 118. The first engagement surface 174 forms one wall of the first groove 171, but does not need to be co-planar with the floor 120 of the rabbet 118. The first engagement surface 174 must only face toward the floor 120 of the rabbet 118, so considerable deviations from parallel are permissible. In certain embodiments, an angle may facilitate interlocking and retention of the annular spacer frame 150. The first receiving section 173 has a first locking surface 175 that is non-parallel to the first engagement surface 174. This provides a feature whereby the annular spacer frame 150 can interlock and cannot be easily withdrawn. However, in some embodiments the locking surface 175 may be omitted.

The second groove 181 has a corresponding second entry section 182 and a corresponding receiving section 183 which are identical to the first entry section 172 and the first receiving section 173. The second entry section 182 has a second engagement surface 184 forming one wall of the second groove 181, the second entry section 182 facing the floor of the rabbet 118. Once again, there is no requirement that the second engagement surface 184 be co-planar with the floor 120 of the rabbet 118. The second receiving section 183 has a second locking surface 185 that is non-parallel to the second engagement surface 184. In other embodiments the first and second grooves 171, 181 are not identical. As can be seen in FIGS. 6A and 6B, the grooves 171, 181 are formed as openings in an extruded material rather than milled out of a solid block of material. In yet other embodiments, there may be three or more grooves, and these grooves may be identical or some grooves may be configured differently from other grooves to prevent assembly in an incorrect orientation or to enhance cost reduction or ease of assembly.

Turning to the annular spacer frame 150, which is shown in the exploded view of FIG. 2, the annular spacer frame 150 engages the annular display frame 110 so that it is positioned within the rabbet 118 and secures the stack formed by the transparent front panel 130 and the rear panel 140 in place. The annular spacer frame 150 prevents any rearward motion of the transparent front panel 130 or the rear panel 140, so that the display article is securely held within the frame apparatus 100. The annular spacer frame 150 has an inner surface 156 which defines a central opening 157, the inner surface 156 being arranged substantially perpendicular to the front surface 112 of the annular display frame 110. In alternate embodiments, the inner surface 156 may be arranged at an angle such that it tapers inward or outward from the perimeter of the annular spacer frame 150, or may have a curvature or other non-planar shape. In some embodiments, a groove may be formed into the inner surface 156 to alter the rigidity of the annular spacer frame 150 or reduce manufacturing cost. The annular spacer frame 150 is specifically designed to have a lower rigidity than the annular display frame 110 so that it can be deformed to facilitate assembly. Furthermore, the annular spacer frame 150 is designed to be manufactured separately from the rear panel 140 and is not affixed to the rear panel 140. Instead, the annular spacer frame is placed in surface contact with the rear panel 140 without any physical attachment.

Figure 3:
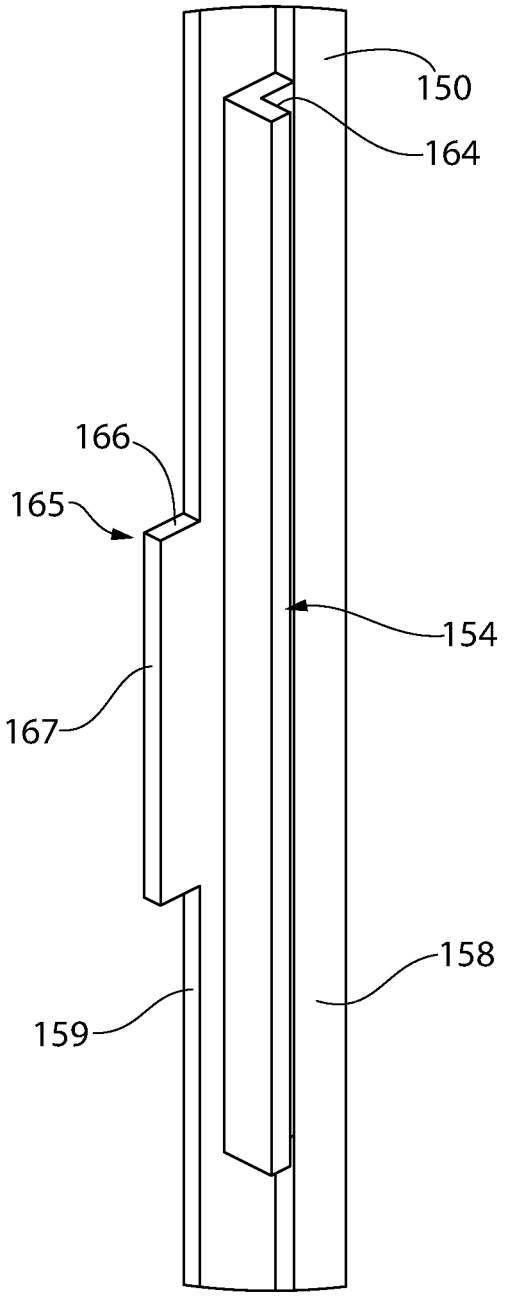
FIG. 3 is an enlarged view of area III of FIG. 2.
Figure 4:
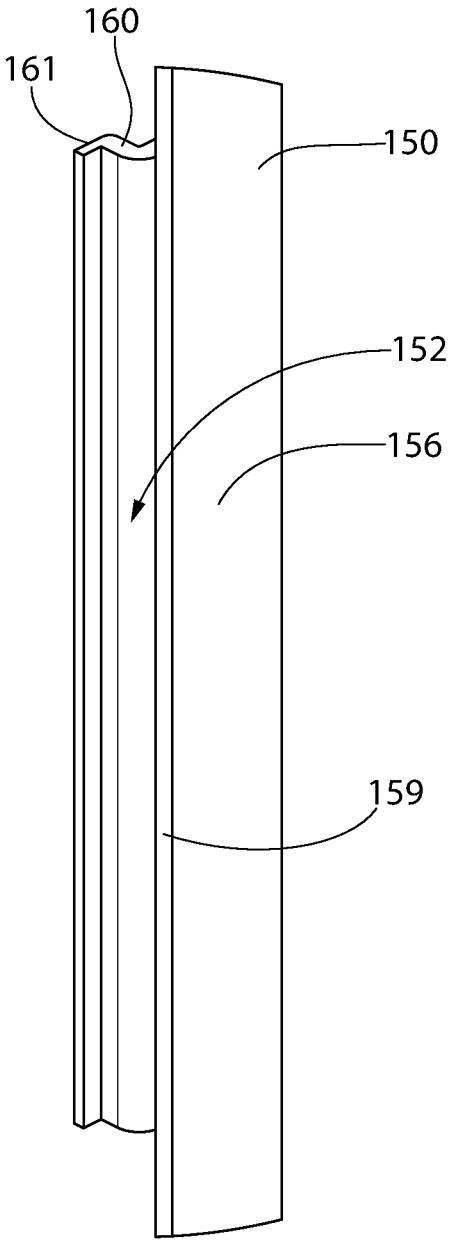
FIG. 4 is an enlarged view of area IV of FIG. 2.

Turning to FIGS. 3 and 4, the annular spacer frame 150 has a first locking tab 152 and a second locking tab 154, the first locking tab 152 being different from the second locking tab 154. The first locking tab 152 is on an opposing side of the annular spacer frame 150 from the second locking tab 154. There is also a third locking tab 152A and a fourth locking tab 154A. In other embodiments, there may be additional locking tabs which provide additional retention for the annular spacer frame 150 or there may be fewer locking tabs if adequate retention of the stack can be obtained with one or two locking tabs. Generally the locking tabs on a single elongate member of the annular spacer frame 150 all have the same profile, but in some embodiments it may be desirable to have locking tabs with different profiles on the same elongate member of the annular spacer frame 150. In some embodiments, only one locking tab is used on each side of the spacer frame 150. In yet other embodiments, there may be locking tabs on three or more sides of the annular spacer frame 150 or only one or two sides of the annular spacer frame 150. It is conceived that locking tabs may be arranged on adjacent sides of the annular spacer frame 150.

The first and third locking tabs 152, 152A of the annular spacer frame 150 engage the first engagement portion 170 of the annular display frame 110. The second and fourth locking tabs 154, 154A of the annular spacer frame 150 engage the second engagement portion 180 of the annular display frame 110. This locks the annular spacer frame 150 and the stack into the rabbet 118 of the annular display frame 110. In the present embodiment, the locking tabs 152, 152A are spaced apart from each other along the elongate member and spaced apart from the ends of the elongate member. Similarly, the locking tabs 154, 154A are spaced apart from each other along the elongate member and spaced apart from the ends of the elongate member. This helps to ensure even pressure is applied to the stack and permits deflection of the annular spacer frame 150 to permit assembly. In embodiments where a single locking tab is used per side, it is generally centered on the elongate member to ensure even distribution of compression force on the stack. However, in yet other embodiments, a single locking tab may be arranged asymmetrically on the elongate member.

The first and third locking tabs 152, 152A protrude from the outer surface 158 of the annular spacer frame 150. The outer surface 158 is the peripheral edge of the annular spacer frame 150, and is opposite the inner surface 156. The first and third locking tabs 152, 152A have a first locking section 160 and a second locking section 161. The first locking section 160 extends from the outer surface 158 in an approximately perpendicular direction. However, in other embodiments the first locking section 160 may extend at any angle from the outer surface 158 that is non-parallel to the outer surface 158. The second locking section 161 extends from the first locking section 160 in a non-parallel direction, facing toward the rear surface 114 of the annular display frame 110 when assembled. In the exemplary embodiment, the second locking section 161 extends perpendicular from the first locking section, but it may extend in any direction that is non-parallel to the first locking section 160.

As can be seen in FIGS. 6A and 6B, the first and third locking tabs 152, 152A extend into the first groove 171 and engage the first engagement surface 174 of the annular display frame 110. Specifically, the first locking section 160 engages the first engagement surface 174 and the second locking section 161 engages the first locking surface 175. The interaction of the second locking section 161 with the first locking surface 175 prevents motion of the annular spacer frame 150 in the plane defined by the central opening 157. The interaction of the first locking section 160 with the first engagement surface 174 retains the annular spacer frame 150 and the stack against the annular display frame 110 in the direction perpendicular to the plane defined by the central opening 157. In other embodiments, the second locking section 161 may be omitted, and movement in the plane defined by the central opening 157 may be avoided by interaction between the outer surface 158 of the annular spacer frame 150 with the wall 122 of the rabbet 118 of the annular display frame 110.

The second and fourth locking locking tabs 154, 154A of the annular spacer frame 150 also protrude from the outer surface 158 of the annular spacer frame 150. The second and fourth locking tabs 154, 154A have a first locking section 164 which extends in a non-parallel direction from the outer surface 158 of the annular spacer frame 150. In the exemplary embodiment, there is no second locking section, but a second locking section may be added to improve retention of the second and fourth locking tabs 154, 154A in the annular display frame 110. The first locking section 164 of the second and fourth locking tabs 154, 154A engages the second engagement portion 180 of the annular display frame 110. Specifically, the first locking section 164 makes contact with the second engagement surface 184. The first locking section 164 may extend perpendicular to the outer surface 158 of the annular spacer frame 150, or may extend at an angle that facilitates assembly or enhances the compression applied by the annular spacer frame 150 against the stack, to prevent the display article from moving when the frame apparatus 100 is handled.

As can be best seen in FIGS. 3, 4, 6A, and 6B, the annular spacer frame 150 is also provided with gripping elements 165. The gripping elements 165 are arranged on the annular spacer frame 150 so that they allow the user to easily flex the annular spacer frame during assembly. The gripping elements 165 comprise a gripping tab 166 protruding from a rear surface 159 of the annular spacer frame 150. Each gripping tab 166 terminates in a distal surface 167, the distal surface 167 being flush or depressed relative to a reference plane defined by the rear surface 114 of the annular display frame 110. In the present embodiment, the gripping elements 165 are located proximate the second and fourth locking tabs 154, 154A. In alternate embodiments, the gripping elements 165 are placed proximate all locking tabs, or placed in any location that permits easy installation and removal of the annular spacer frame 150.

During assembly of the frame apparatus, the user places the transparent front panel 130 into the rabbet 118 of the annular display frame 110. The display article is placed onto the transparent front panel 130, followed by the rear panel 140. Finally, the first and third locking tabs 152, 152A of the annular spacer frame 150 are engaged with the first engagement portion 170 of the annular display frame 110, inserting the second locking section 161 into the first groove 171. The annular spacer frame 150 is then rotated such that the second locking section 161 engages the first locking surface 175 and the first locking section 160 engages the first engagement surface 174. This causes a compression force to be applied to the stack as the annular spacer frame 150 drops into the rabbet 118. The user then deflects the second and fourth locking tabs 154, 154A using the gripping elements 165 and inserts the first locking section 164 of the second and fourth locking tabs 154, 154A into the second engagement portion 180 of the annular display frame 110. As pressure on the gripping elements 165 is released, the annular spacer frame 150 relaxes and the second and fourth locking tabs 154, 154A sit tightly in the second engagement portion 180, with the first locking section 164 engaging the second engagement surface 184. A further compression force is applied by the second and fourth locking tabs 154, 154A as they interact with the second engagement surface 184, which enhances the compression of the stack to retain the display article. The fully assembled state is known as the first state. The second state is achieved when the annular spacer frame 150 is deflected such that the second and fourth locking tabs 154, 154A are disengaged from the second engagement portion 180. In alternate embodiments, the first and third locking tabs 152, 152A may be disengaged from the first engagement portion 170 to release the annular spacer frame 150 instead of the second and fourth locking tabs 154, 154A.

The compression forces applied by the annular spacer frame 150 as it interacts with the first and second engagement portions 170, 180 are the product of the locking tabs 152, 152A, 154, 154A having an elasticity that functions as a spring. In alternate embodiments, a separate spring feature may be formed on the annular spacer frame 150 to provide the desired compression force. In yet other embodiments, a portion of the annular display frame 110 may provide the required compression force. In yet further embodiments, a compressible material may be applied to one of the annular spacer frame 150 or the annular display frame 110 to provide the required compression force.

The annular spacer frame 150 is intended to have a lower rigidity than the annular display frame 110 so that it is capable of being deflected as it is installed into the annular display frame. In this context, a component is said to have greater rigidity when, for a given length, the component deflects less than the component against which it is compared. Thus, the annular spacer frame 150 is capable of deflecting more than the annular display frame 110 when comparing elongate members of equal length. It is intended that the annular spacer frame 150 of the frame apparatus 100 be designed with a lower rigidity so that it can always be deflected for easy assembly. This lower rigidity may be obtained by materials selection (i.e. choosing a material that has a lower stiffness for the annular spacer frame 150 than the stiffness of the material used for the annular display frame 110) or by design. In achieving the desired lower rigidity, it is possible that the annular spacer frame 150 have features that intentionally lower the rigidity of the annular spacer frame 150. This intentional design may be used to selectively lower the in-plane stiffness of the annular spacer frame 150 while not having a lesser effect on the stiffness of the annular spacer frame 150 in a direction perpendicular to the plane formed by the front surface 112 of the annular display frame 110. Thus, the stiffness may be different in orthogonal directions, so that the annular spacer frame 150 is easy to deflect to engage the locking tabs 152, 154, but provides a strong compression force against the stack.

When the annular spacer frame 150 is installed into the annular display frame 110, the floor 120 of the rabbet 118 conceals the annular spacer frame 150 when the frame apparatus 100 is viewed from the front surface 112 of the annular display frame 110. The inner surface 156 of the annular spacer frame 150 is outwardly offset from the inner surface 116 of the annular display frame 110 by an offset distance D. In some embodiments, the inner surface 156 is coplanar with the inner surface 116. In yet other embodiments, the inner surface 156 is inwardly offset from the inner surface 116 of the annular display frame 110.

Furthermore, the annular spacer frame 150 has a thickness which is less than the depth of the rabbet 118 so that the annular spacer frame 150 is recessed from the rear surface 114 of the annular display frame 110. This permits the frame apparatus 100 to be hung on a wall or other vertical surface, with the rear surface 114 of the annular display frame 110 flush against the wall.

In the preferred embodiment, the annular spacer frame 150 is integrally formed as a singular monolithic component. The annular spacer frame 150 is most preferably injection molded, but may be formed by other methods. This provides a sufficiently rigid structure which may be manufactured cheaply, and improves the ease of assembly. The annular spacer frame 150 is formed as a plurality of elongate members which form the periphery of the annular spacer frame 150. In alternate embodiments, the elongate members may be formed as individual elongate members which are individually formed and inserted into the annular display frame 110. In yet further embodiments, the annular spacer frame 150 may be formed in separate portions to avoid the need for unusually large injection mold tools or other fabrication equipment.

In the exemplary embodiment, hanger elements 168 are incorporated into the annular spacer frame 150 to permit hanging on a nail, hook, or other device mounted on a wall or other surface. The hanger elements 168 may be located on two adjacent sides of the annular spacer frame 150 to permit mounting in a landscape or portrait orientation, or may be included on all four sides for user convenience. The hanger elements 168 are generally formed at the midpoint of the elongate members so that the frame apparatus 100 will hang level. In yet other embodiments, the hangers 168 may be omitted.

Figure 7:
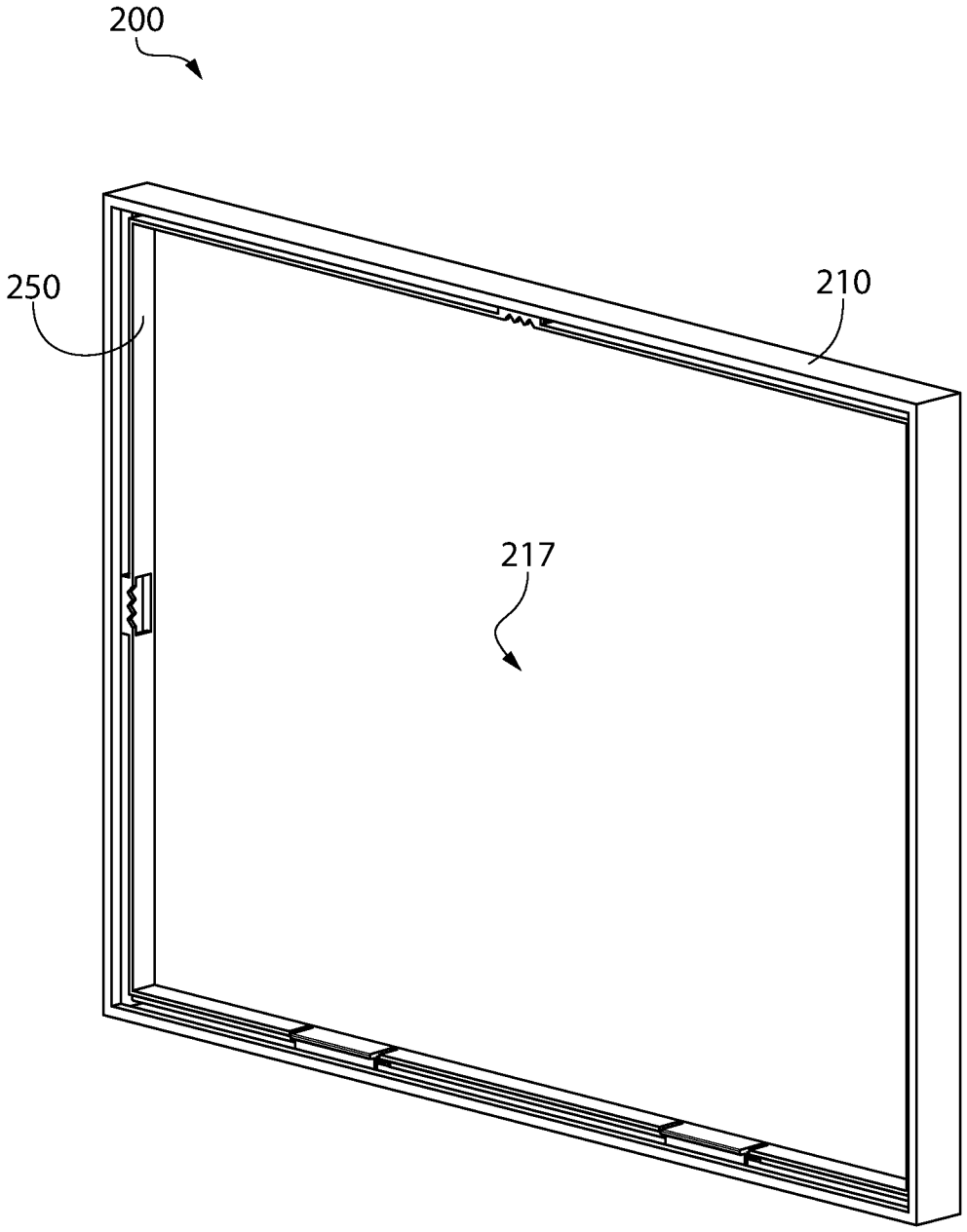
FIG. 7 is a rear perspective view of a frame apparatus according to a second embodiment of the present invention.
Figure 8:
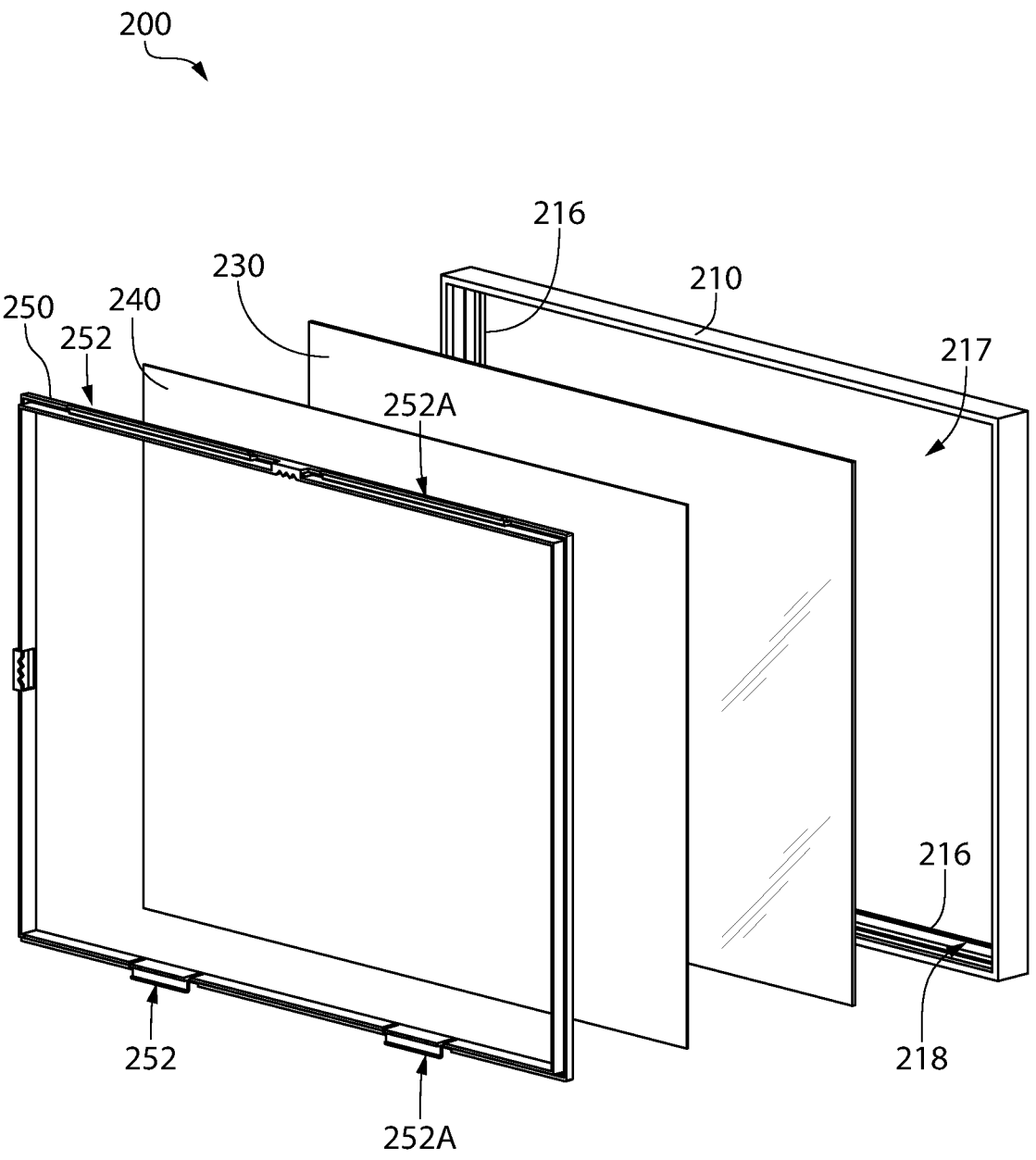
FIG. 8 is an exploded view of the frame apparatus of FIG. 7.
Figure 9:
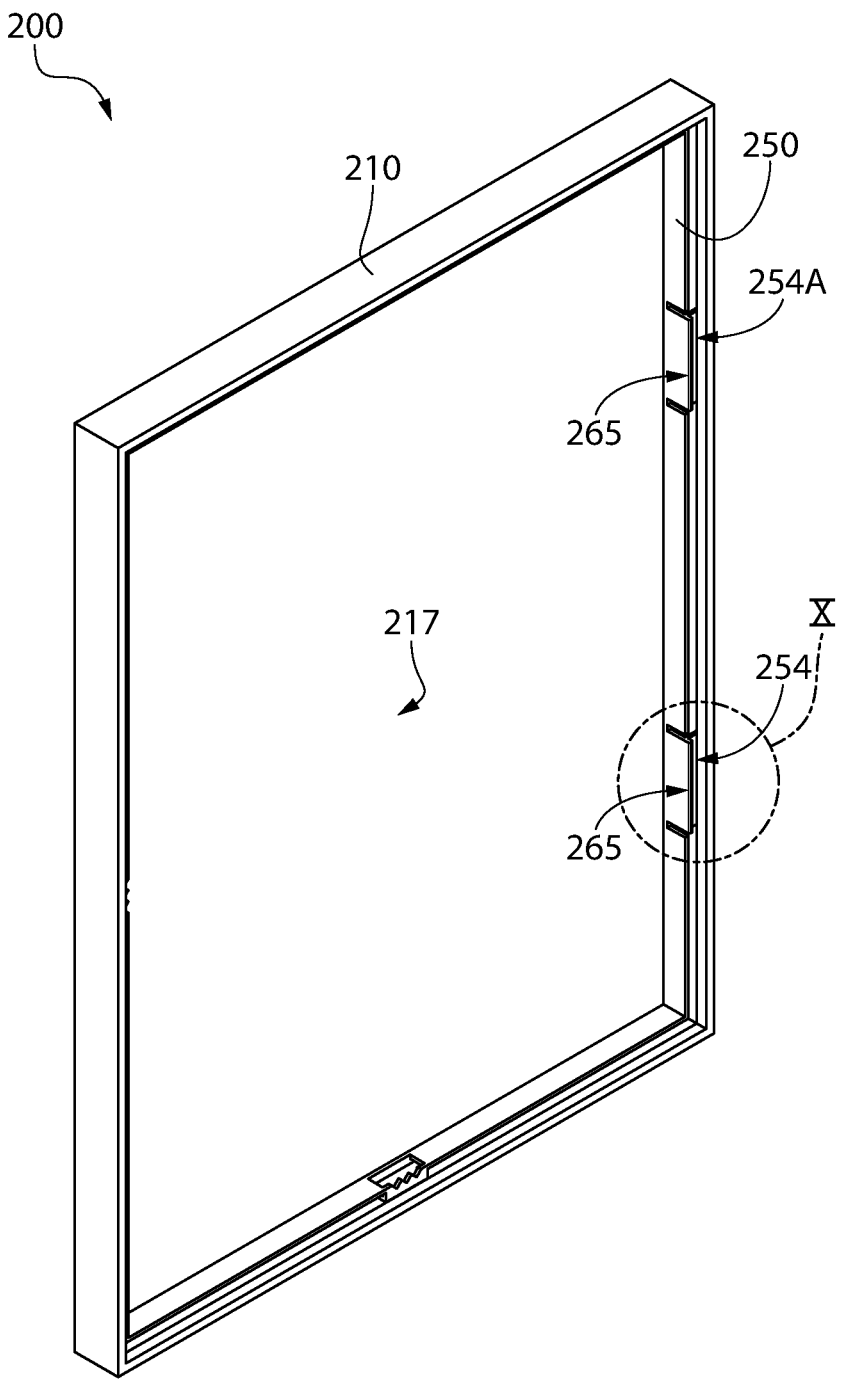
FIG. 9 is another rear perspective view of the frame apparatus of FIG. 7.
Figure 12A:
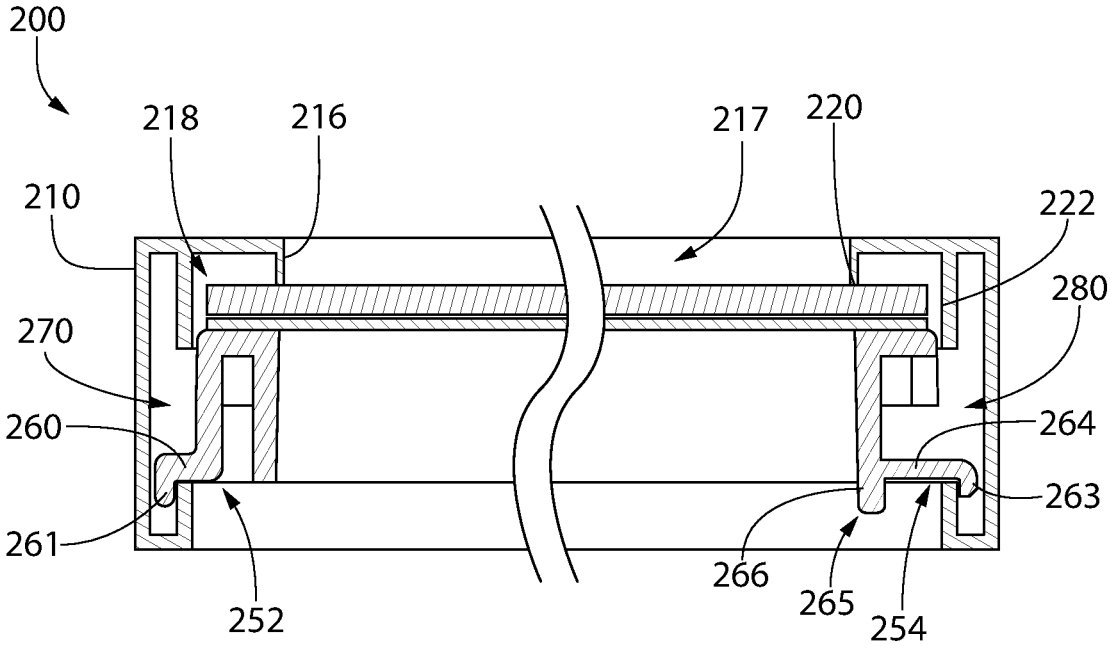
FIG. 12A is a cross-sectional view taken along line XII A-XII A of FIG. 11.
Figure 12B:
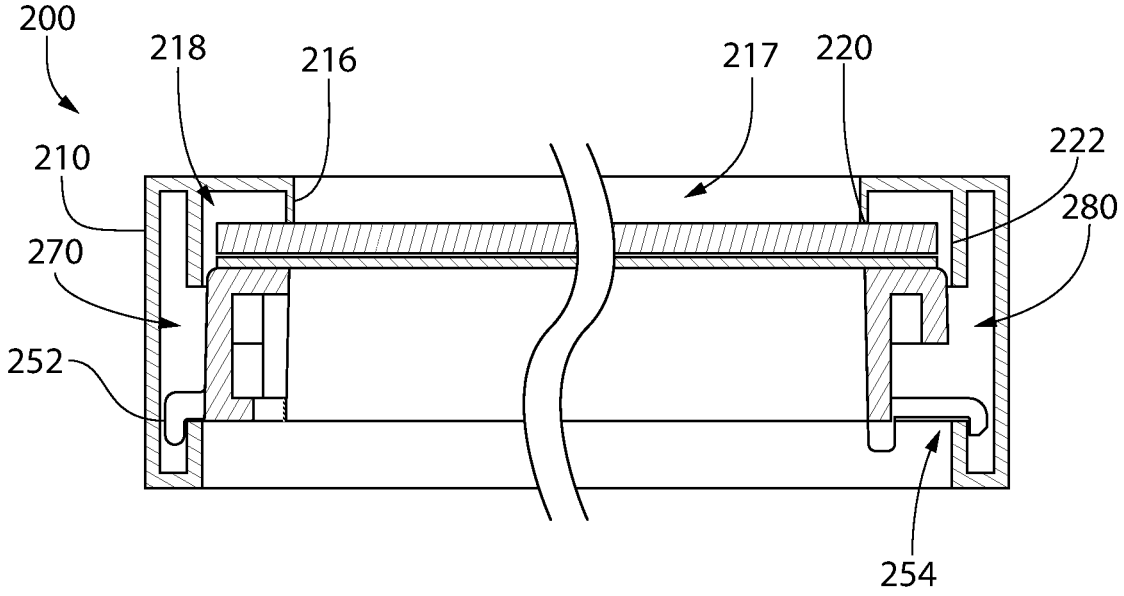
FIG. 12B is a cross-sectional view taken along line XII B-XII B of FIG. 11.

FIGS. 7 and 8 disclose a second embodiment of the frame apparatus of the present invention. In an effort to avoid duplicative disclosure, all features not specifically mentioned are equivalent except as expressly disclosed. The frame apparatus 200 comprises an annular display frame 210, a transparent front panel 230, a rear panel 240, and an annular spacer frame 250. The frame apparatus 200 functions in substantially the same manner as the frame apparatus 100 discussed above. The annular display frame 210 has a display opening 217 formed by the inner surface 216 of the annular display frame 210. As best seen in FIGS. 12A and 12B, the annular display frame 210 also has a rabbet 218 which accepts the transparent front panel 230, the rear panel 240, and the annular spacer frame 250. Once again, the rabbet 218 has a floor 220 and a wall 222. Within the wall 222 is a first engagement portion 270 and a second engagement portion 280.

Figure 10:
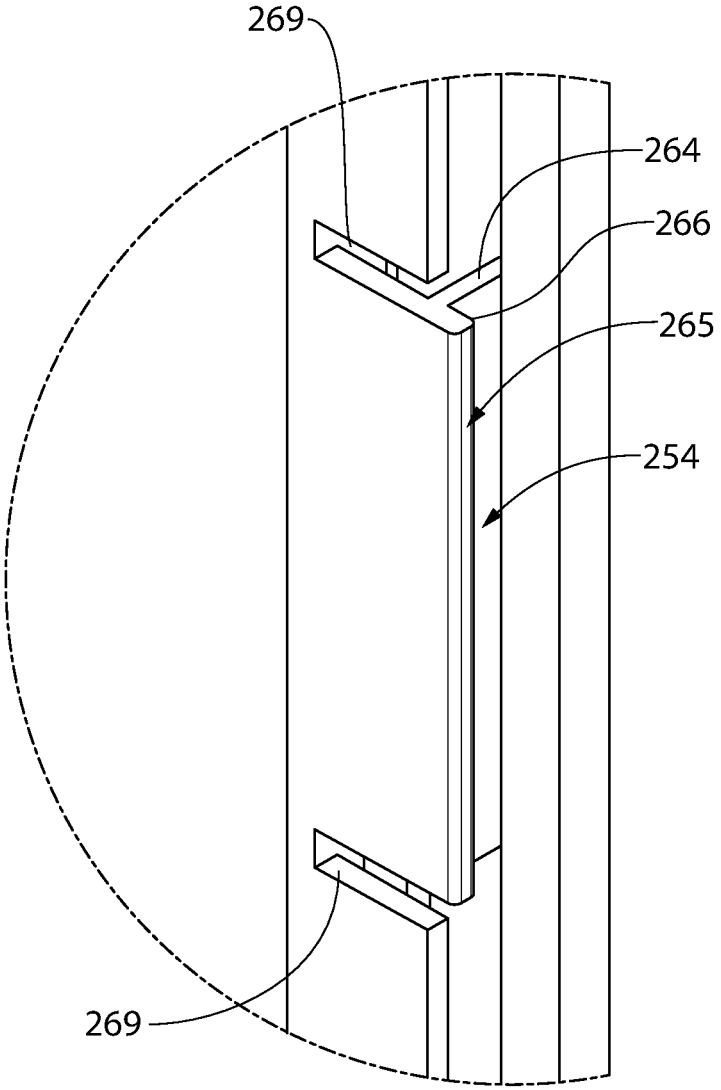
FIG. 10 is an enlarged view of area X of FIG. 9.
Figure 11:
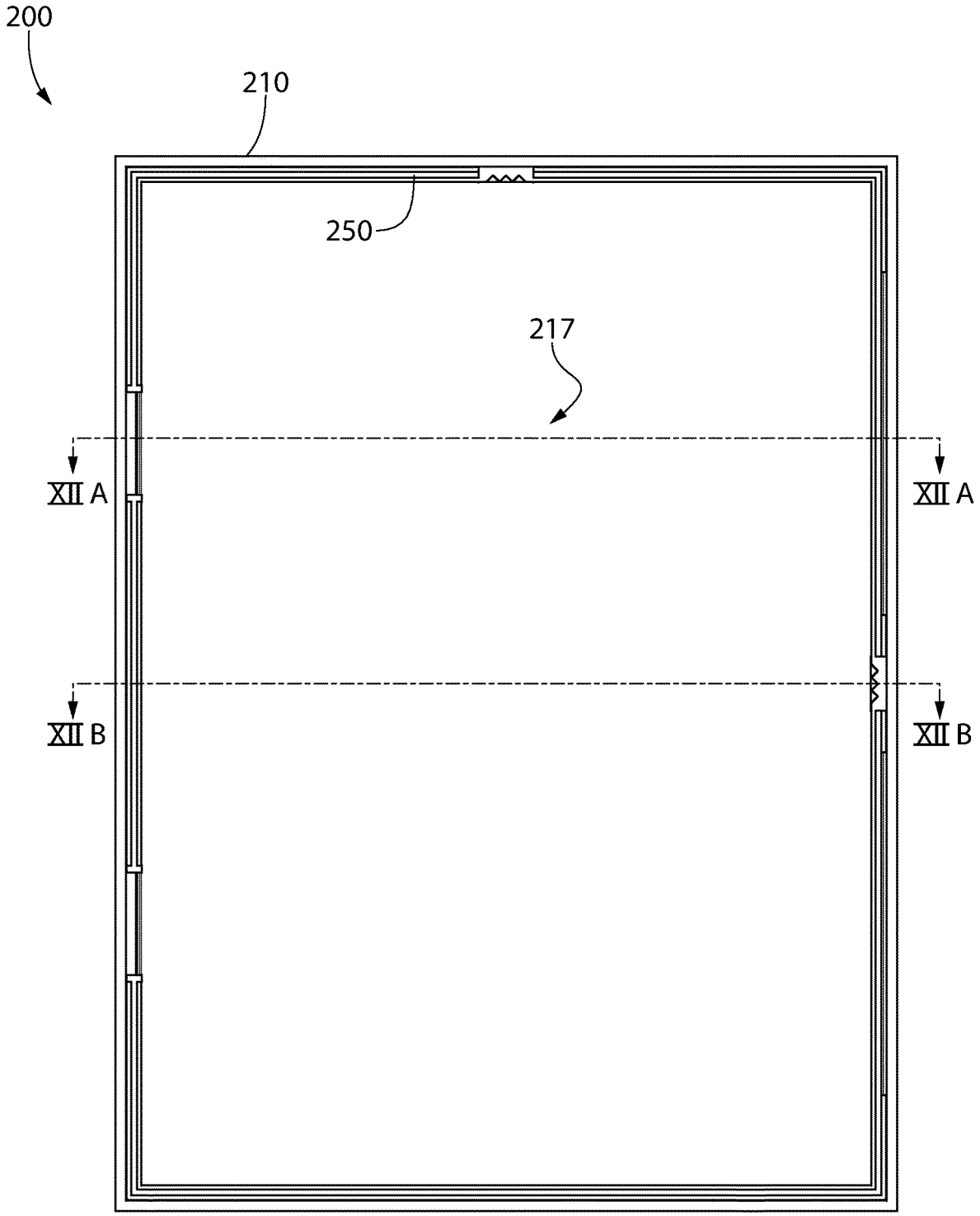
FIG. 11 is a rear view of the frame apparatus of FIG. 1.

As best seen in FIGS. 10, 12A, and 12B, the annular spacer frame 250 has a corresponding set of first and third locking tabs 252, 252A and second and fourth locking tabs 254, 254A which engage the first and second engagement portions 270, 280 of the annular display opening. The first and third locking tabs 252, 252A have a first locking section 260 and a second locking section 261 arranged in a similar configuration to the locking tabs 152 of the annular spacer frame 150 of the first embodiment. The second and fourth locking tabs 254, 254A also have both a first locking section 264 and a second locking section 263, the second locking section extending approximately parallel with the outer surface 258 of the annular spacer frame 250. In other embodiments, the second locking section 263 may extend at any angle which is non-parallel with the first locking section 264. The second locking section 263 increases the retention of the annular spacer frame 250 into the first and second engagement portions 270, 280 to prevent accidental release of the annular spacer frame 250.

The annular spacer 250 also has gripping elements 265 comprising gripping tabs 266 protruding from a rear surface 259 of the annular spacer frame 250. In contrast with the gripping elements 165 of the annular spacer 150 of the frame apparatus 100, these gripping elements 265 also have slots 269 on either side of the gripping tabs 266 which increase the flexibility of the second and fourth locking tabs 254, 254A so that they can more easily be inserted into the second engagement portion 280. Collectively, each of the respective gripping elements 265 and the locking tabs 254, 254A form a latch mechanism when they are bordered by slots 269. This is best shown in FIG. 10, which provides a detailed view of the second locking tab 254. These latch mechanisms permit individual locking of the second and fourth locking tabs 254, 254A due to the additional flexibility afforded by the slots 269.

Turning to the third embodiment of the present invention, the frame apparatus 300 disclosed in FIGS. 13-19 has an annular display frame 310, a transparent front panel 330, a rear panel 340, and an annular spacer frame 350. The annular display frame 310 has a display opening 317 formed by the inner surface 316 of the annular display frame 310. The annular display frame 310 also has a rabbet 318 which accepts the transparent front panel 330, the rear panel 340, and the annular spacer frame 350. Once again, the rabbet 318 has a floor 320 and a wall 322. Within the wall 322 is a first engagement portion 370 and a second engagement portion 380.

Figure 13:
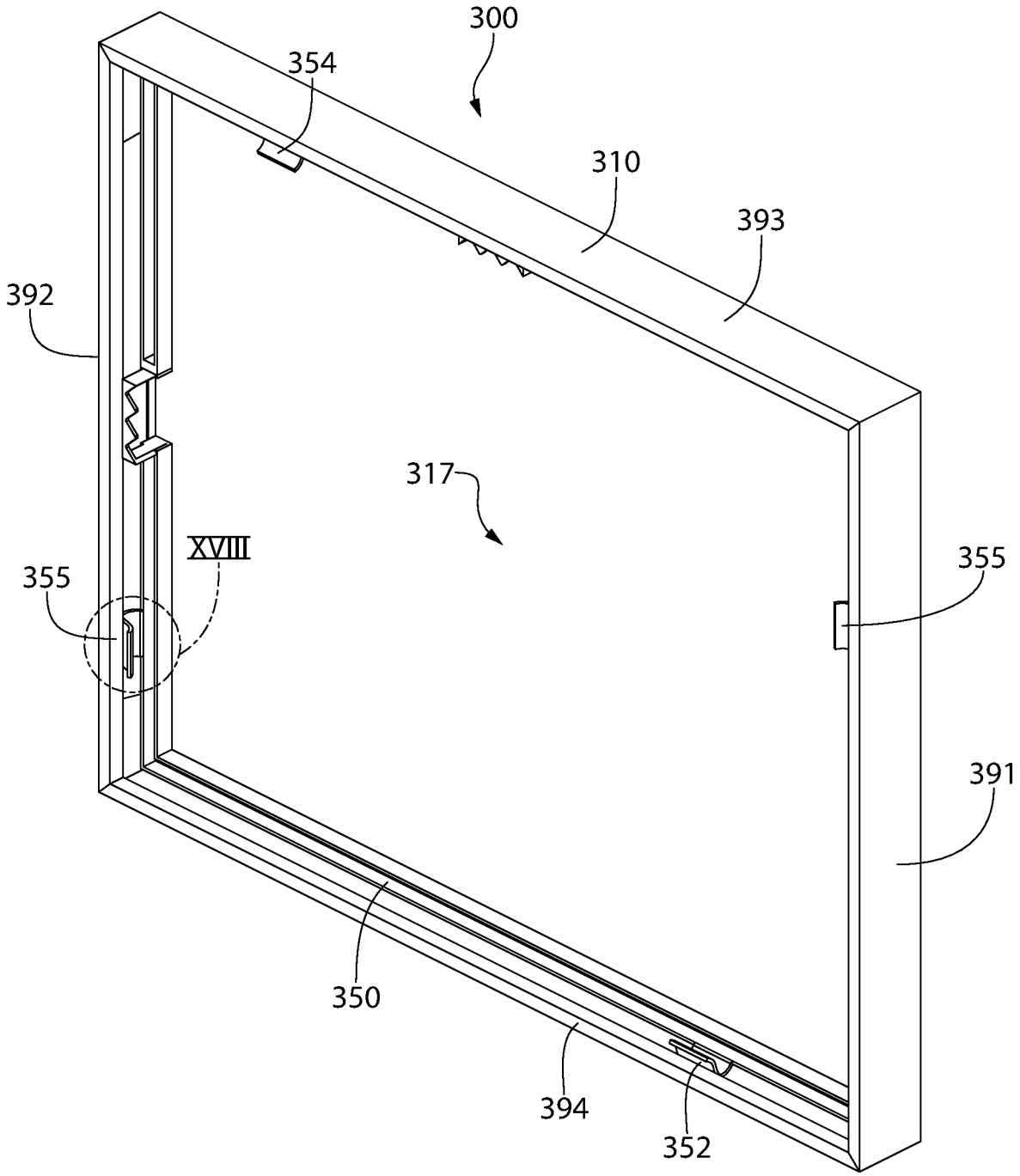
FIG. 13 is a rear perspective view of a frame apparatus in accordance with a third embodiment of the present invention.
Figure 14:
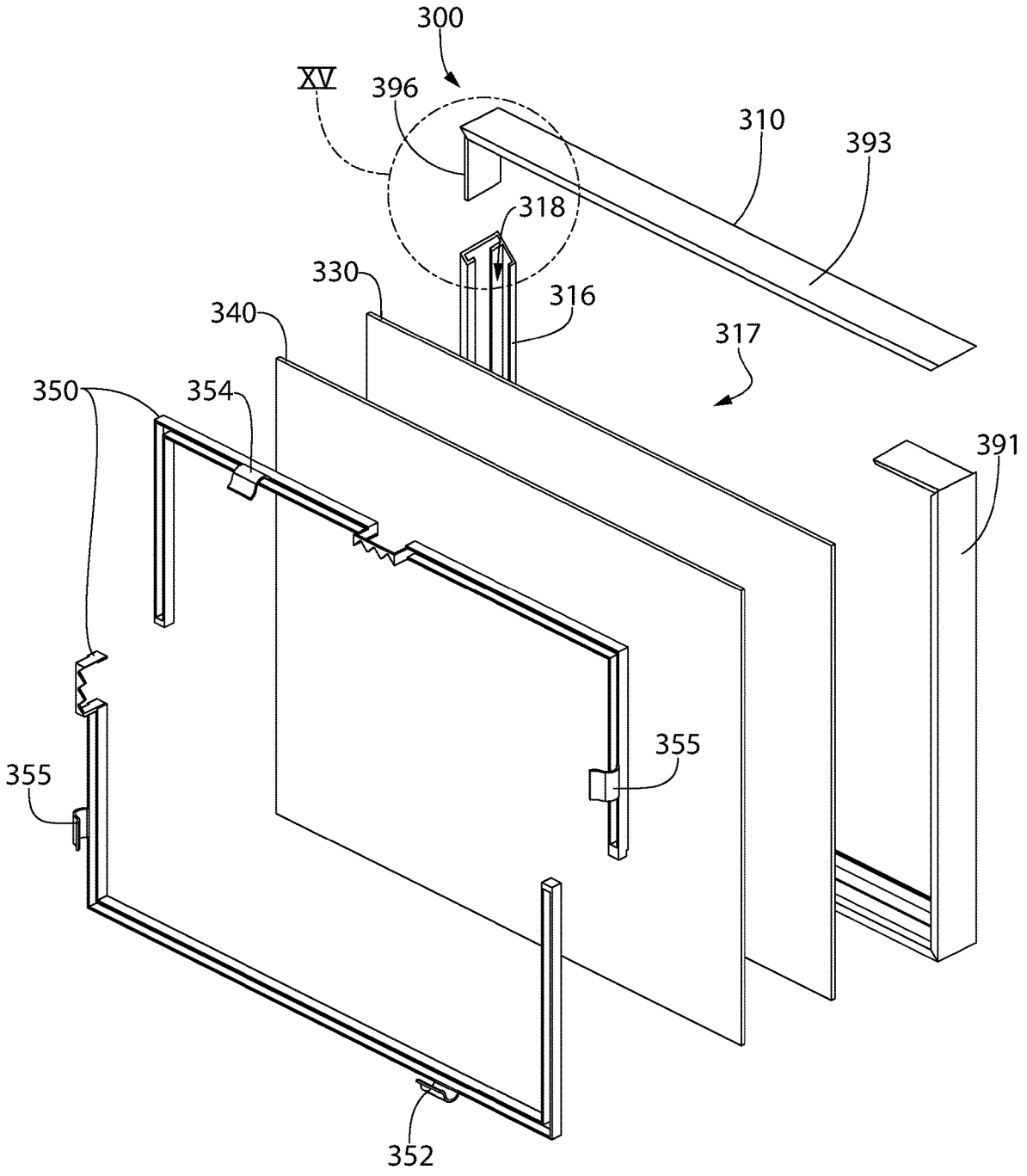
FIG. 14 is an exploded view of the frame apparatus of FIG. 13.
Figure 15:
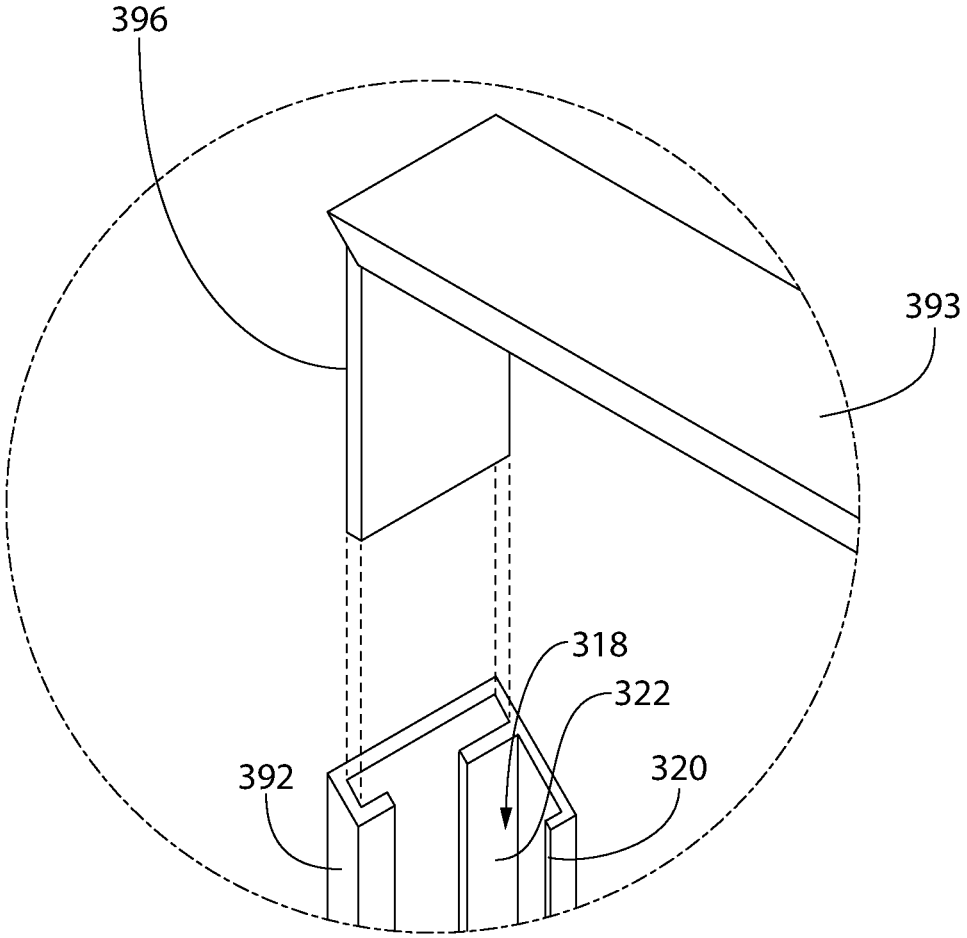
FIG. 15 is an enlarged view of area XV of FIG. 14.
Figure 16:
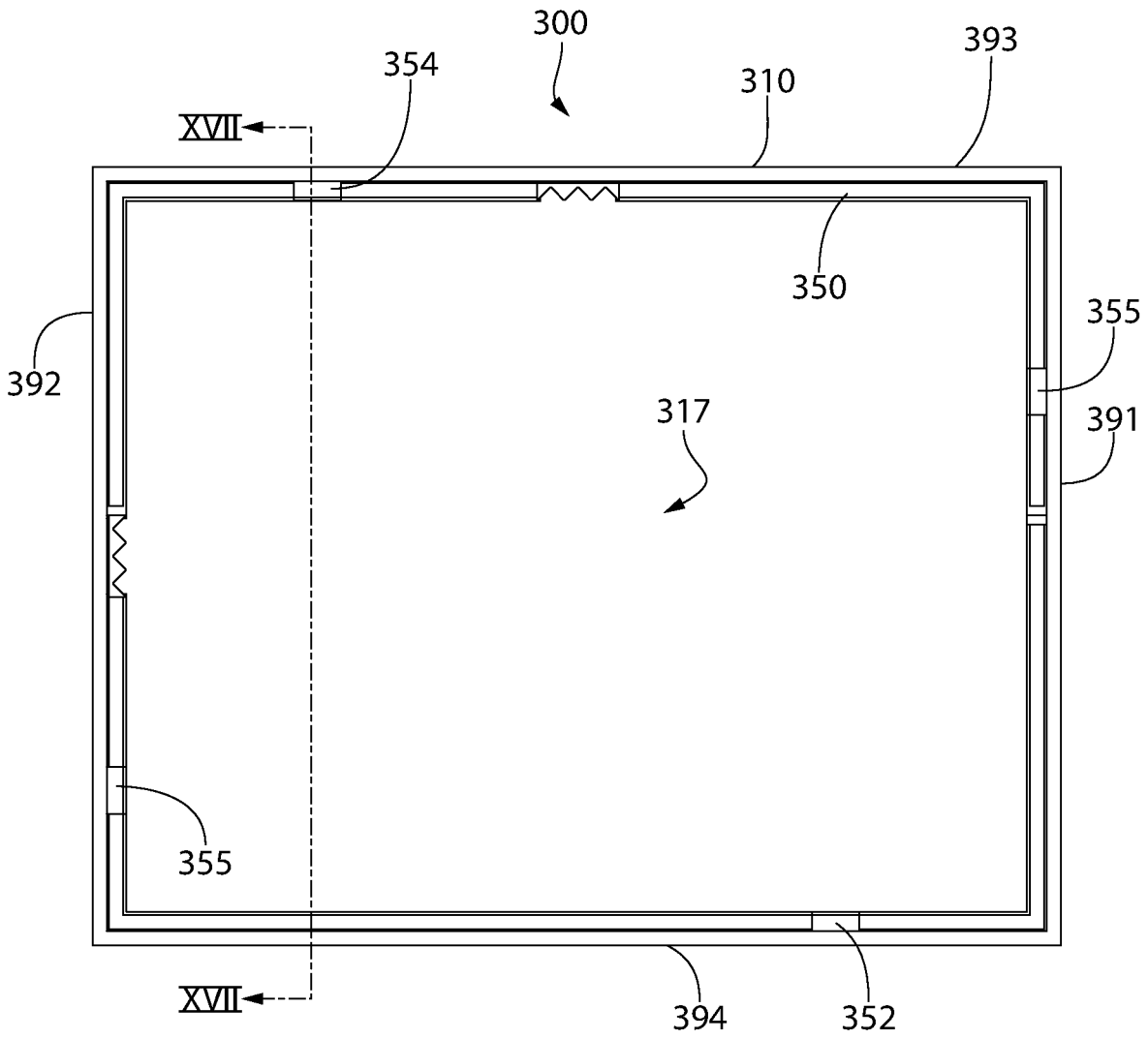
FIG. 16 is a rear view of the frame apparatus of FIG. 13.
Figure 17:
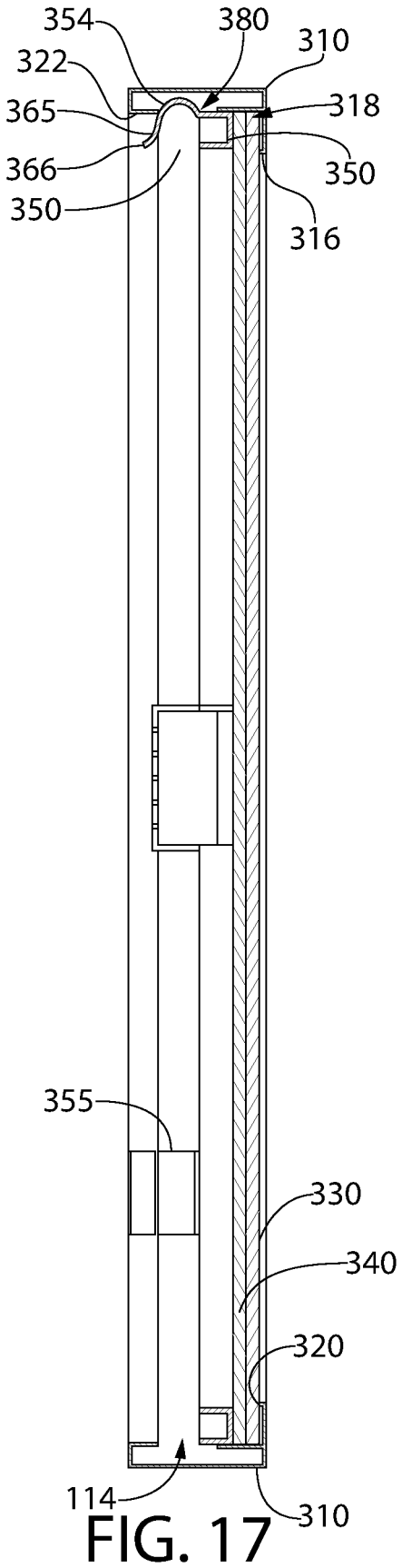
FIG. 17 is a cross-sectional view taken along line XVII-XVII of FIG. 16.
Figure 18:
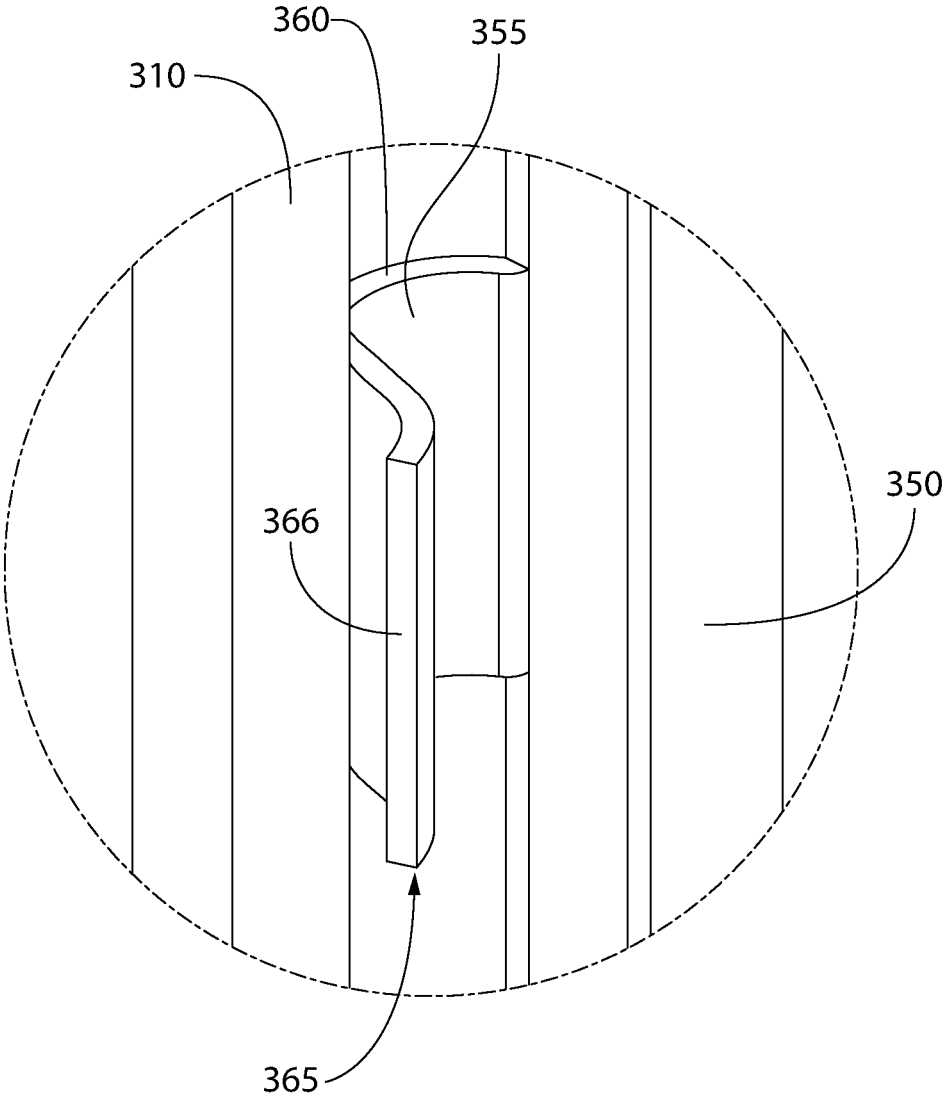
FIG. 18 is an enlarged view of area XVIII of FIG. 13.
Figure 19:
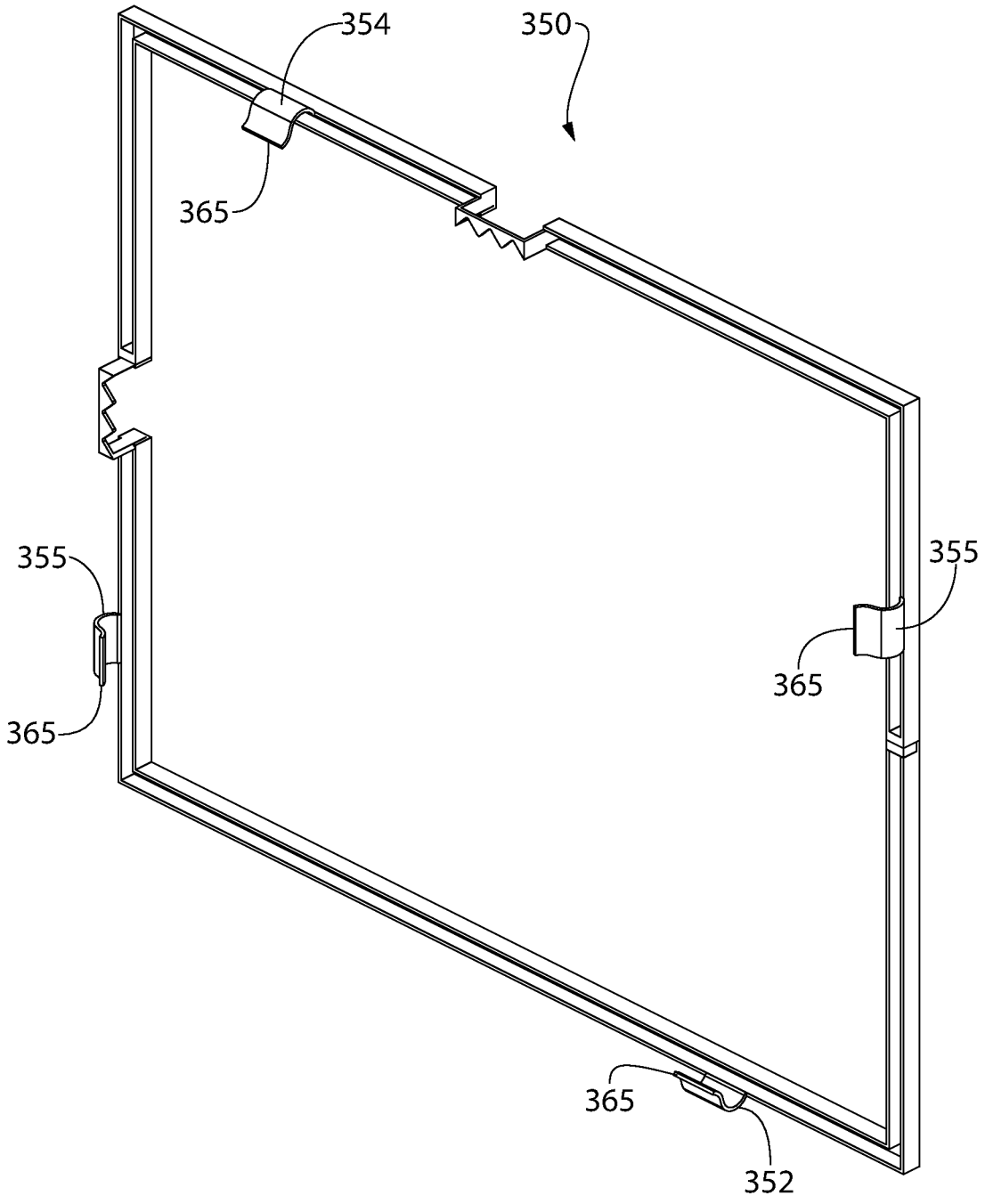
FIG. 19 is a rear perspective view of the annular spacer frame of FIG. 13.
Figure 20:
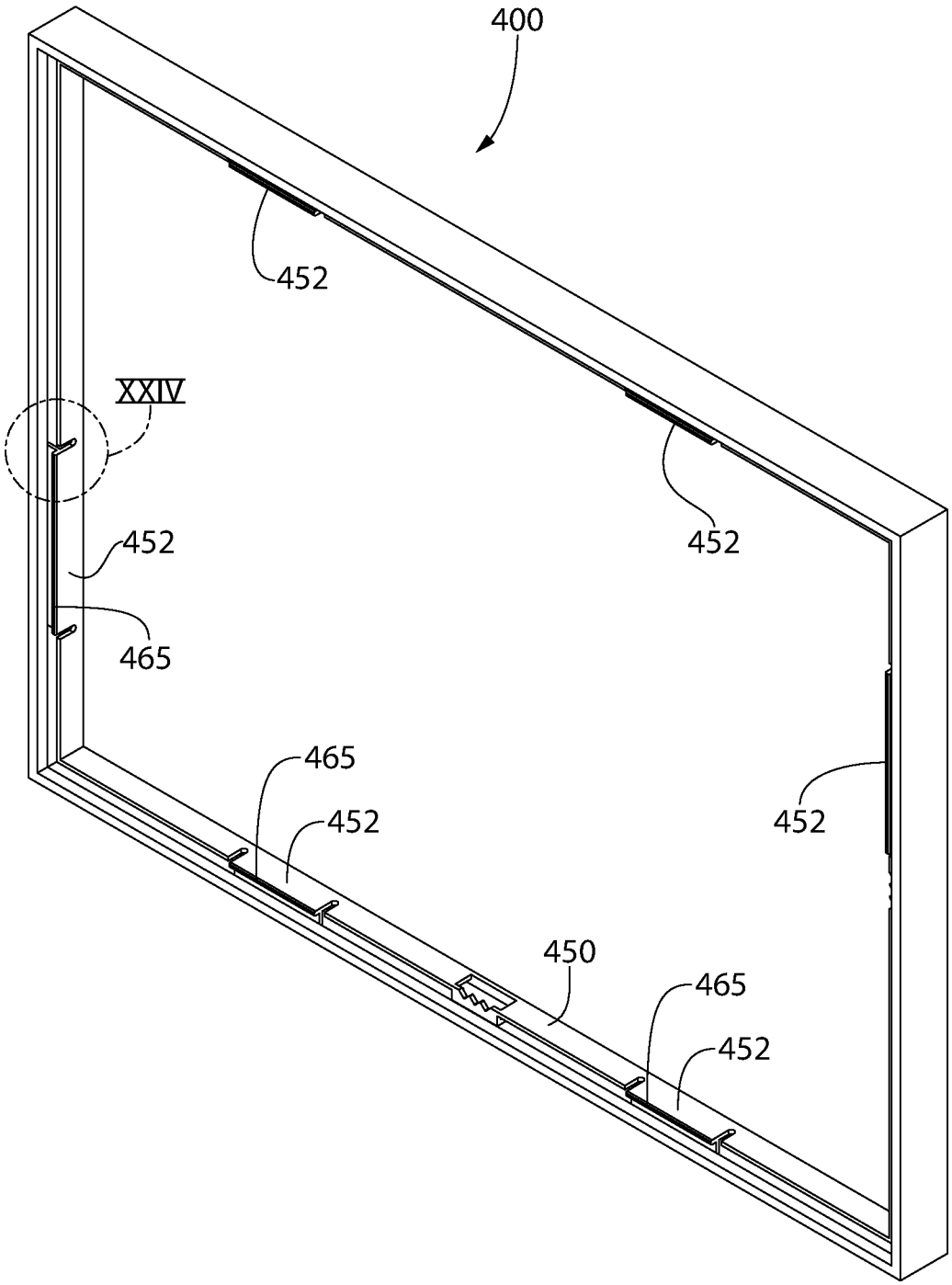
FIG. 20 is a rear perspective view of a frame apparatus according to a fourth embodiment of the present invention.
Figure 21:
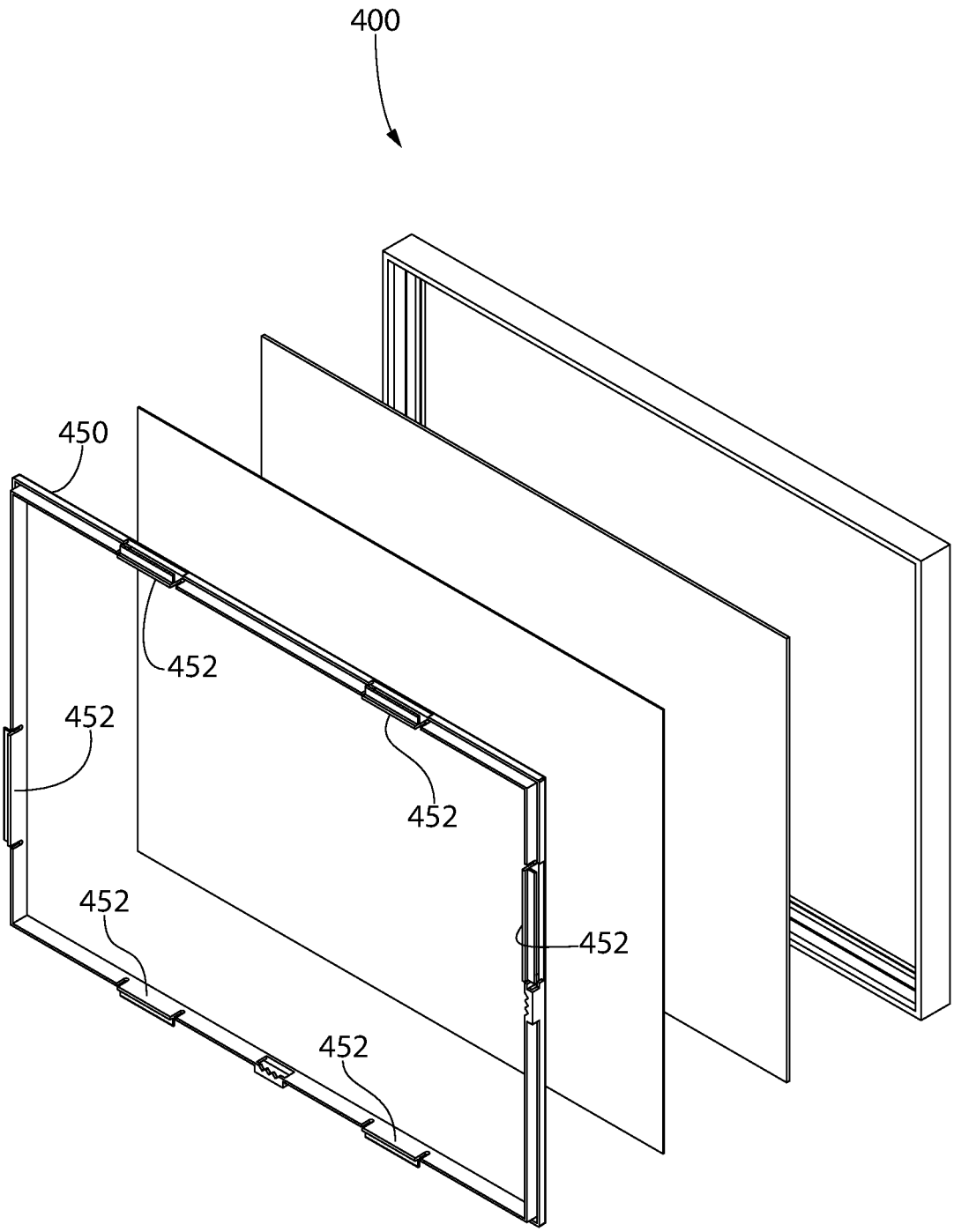
FIG. 21 is an exploded view of the frame apparatus of FIG. 20.
Figure 22:
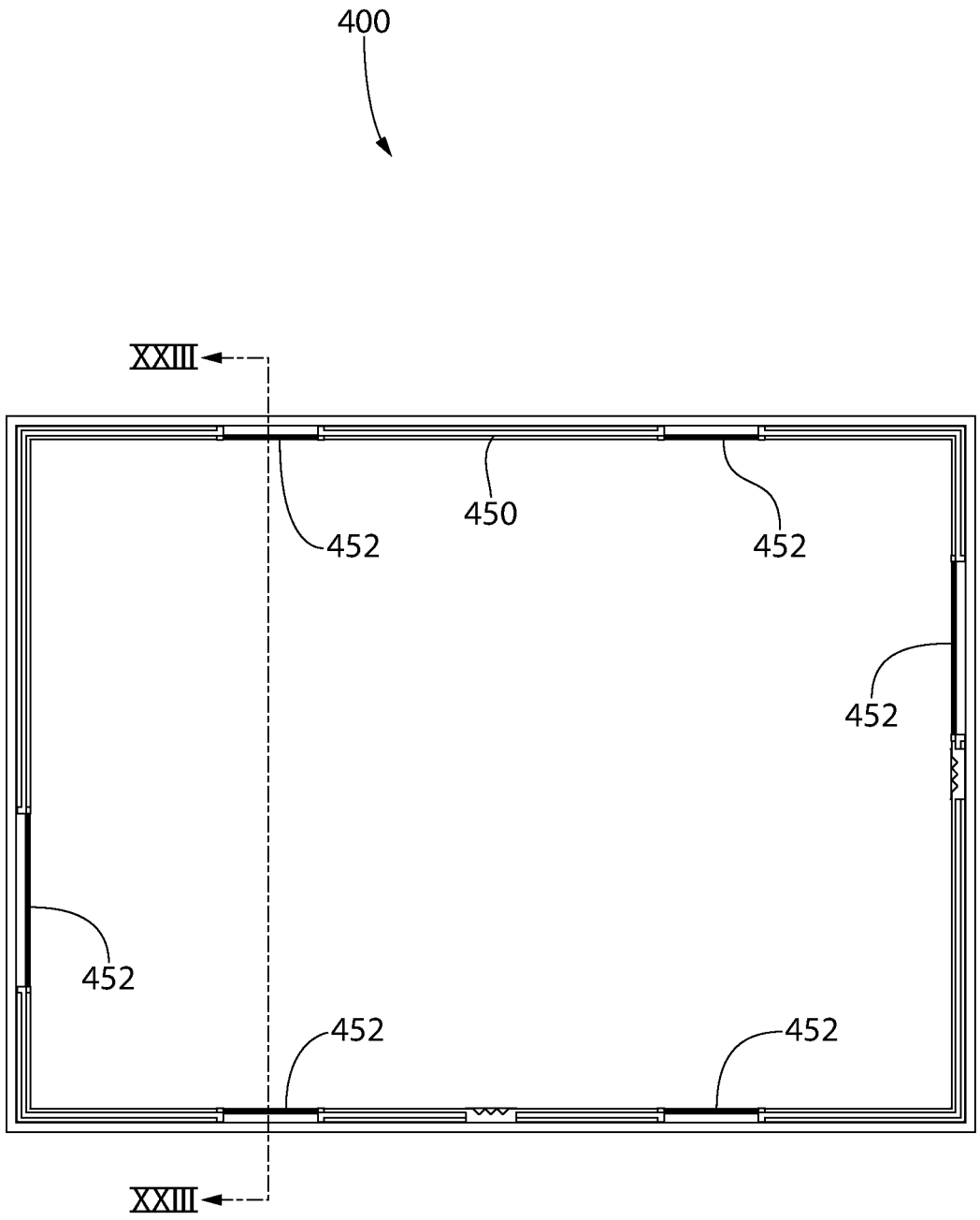
FIG. 22 is a rear view of the frame apparatus of FIG. 20.
Figure 23:
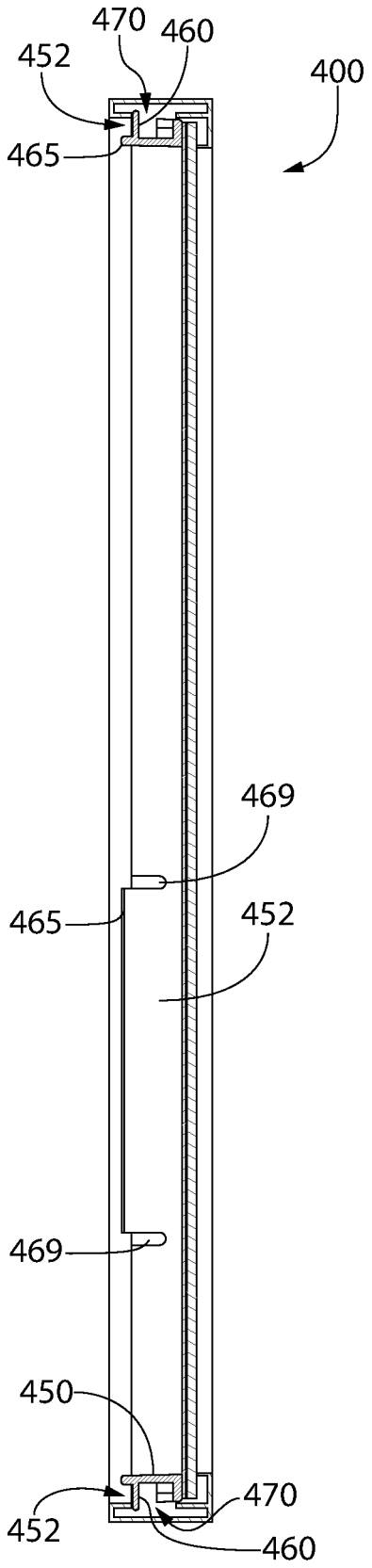
FIG. 23 is a cross-sectional view taken along line XXIII-XXIII of FIG. 22.
Figure 24:
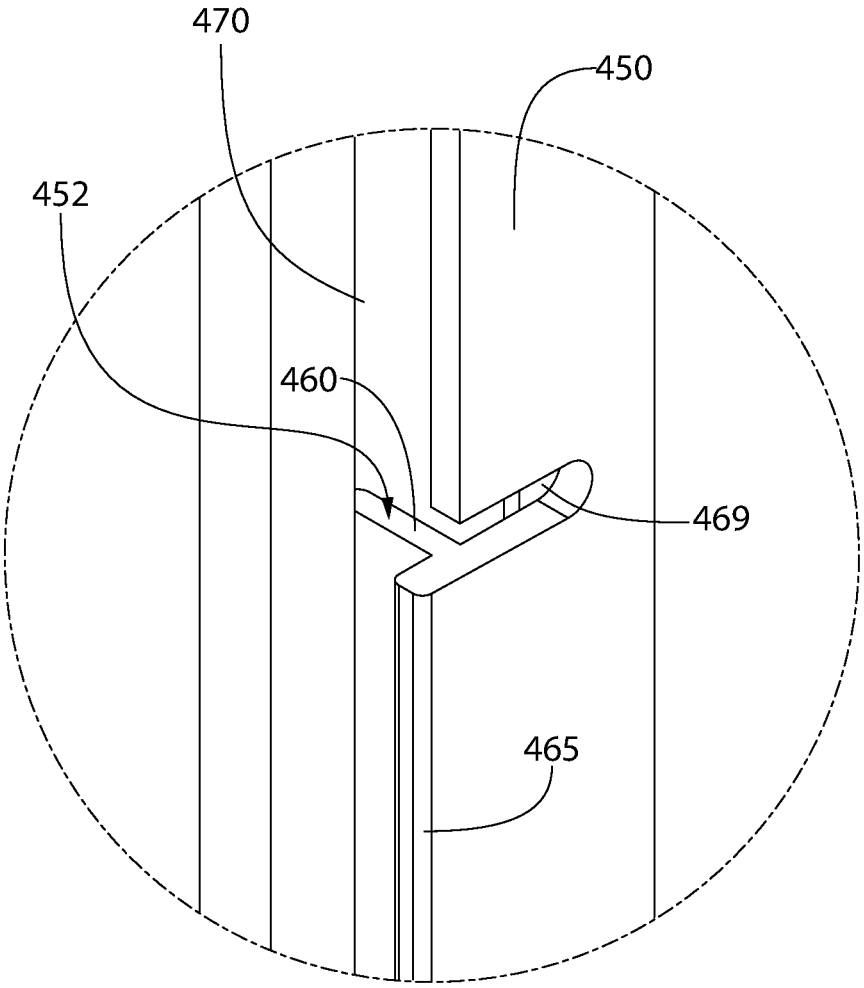
FIG. 24 is an enlarged view of area XXIV of FIG. 20.
Figure 25:
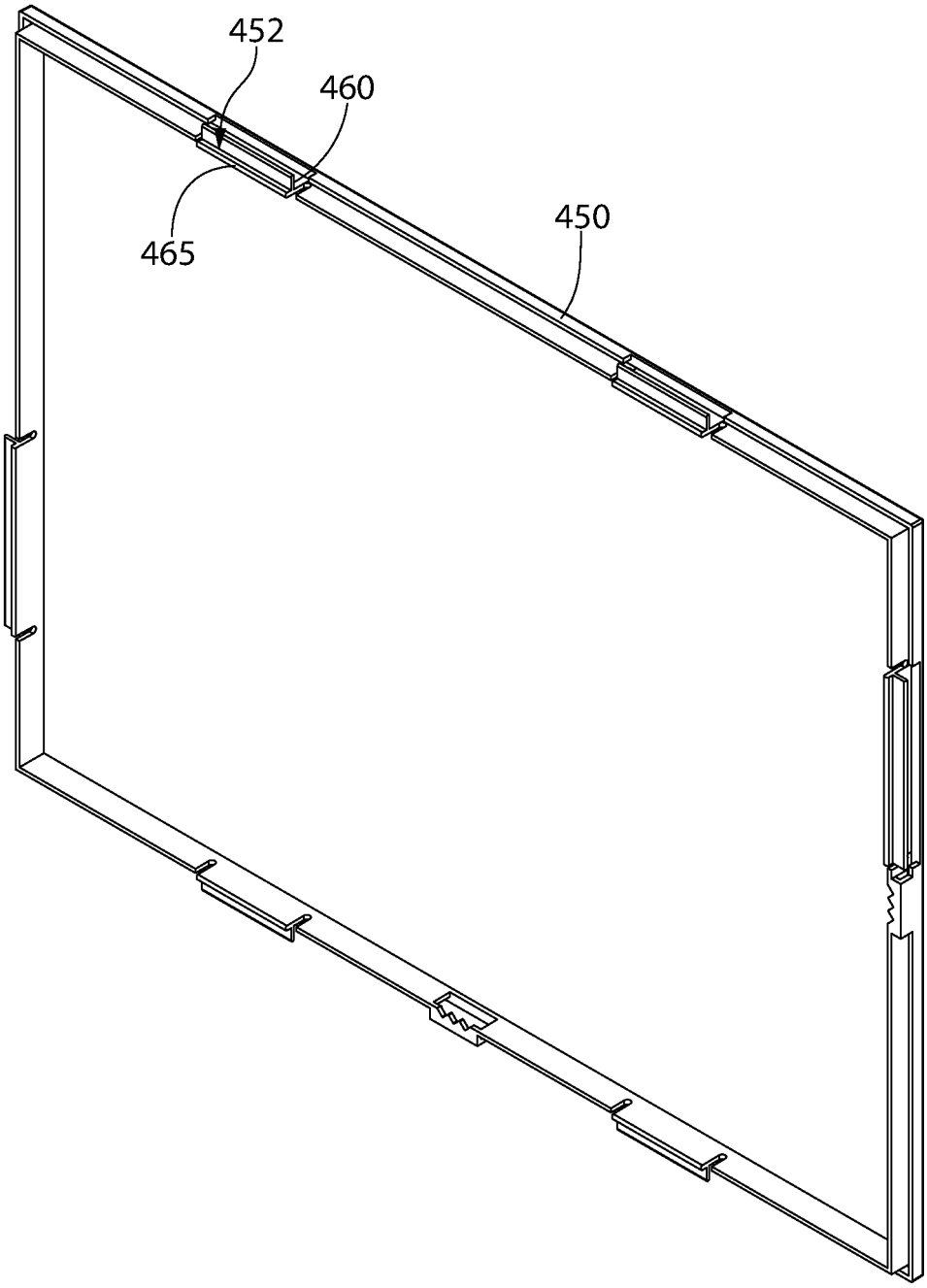
FIG. 25 is a rear perspective view of the annular spacer frame of FIG. 20.
Figure 26:
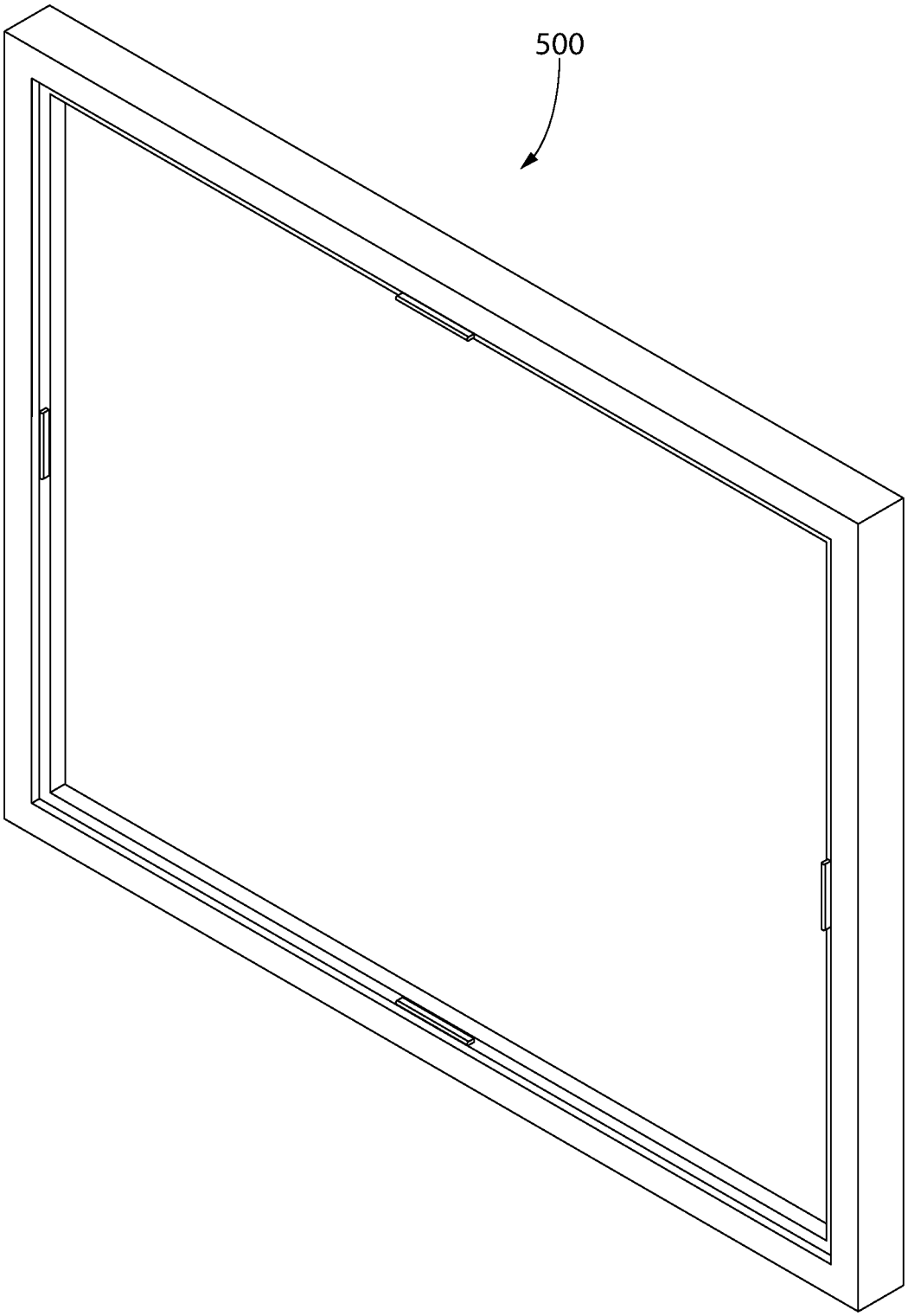
FIG. 26 is a rear perspective view of a frame apparatus according to a fifth embodiment of the present invention.
Figure 27:
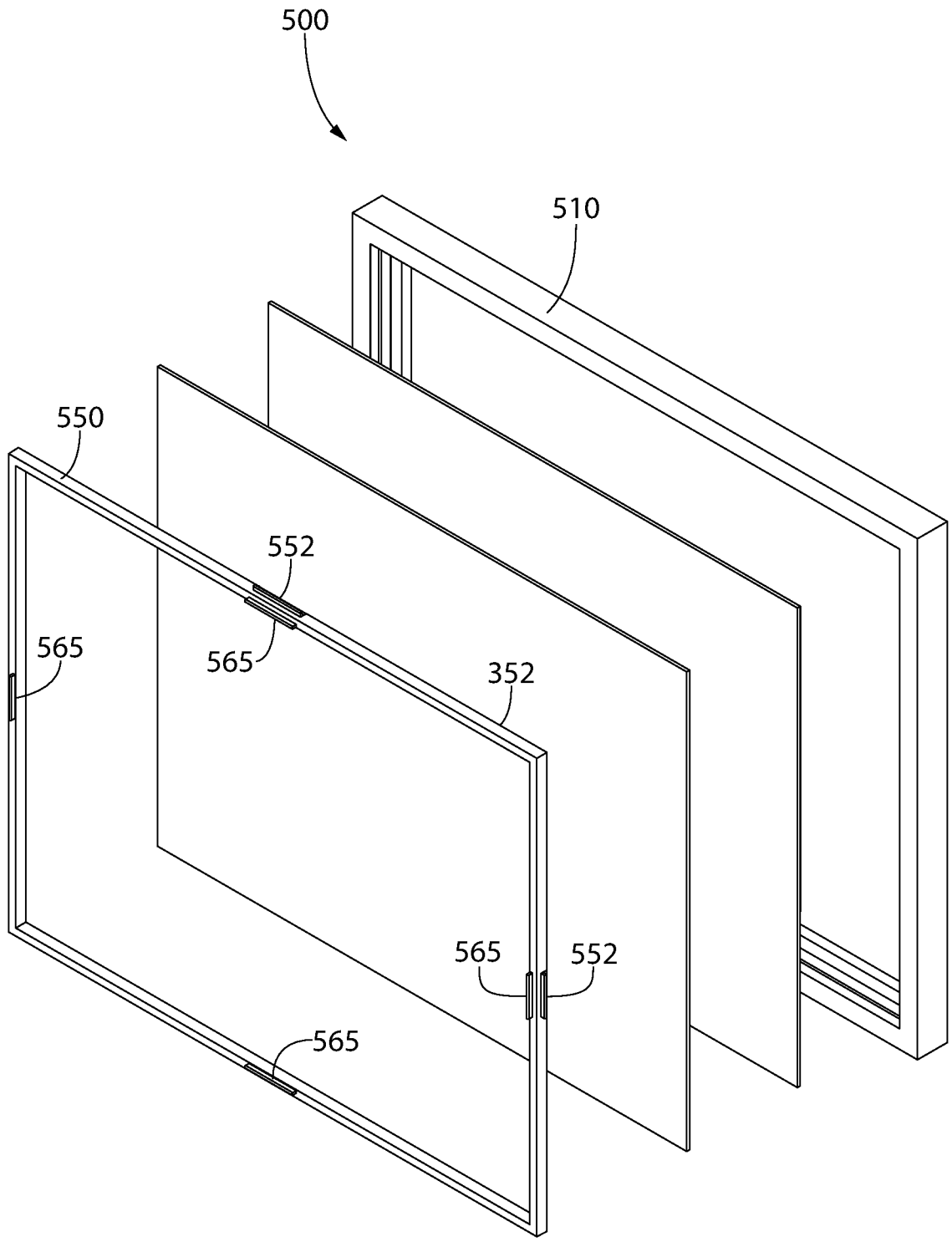
FIG. 27 is an exploded view of the frame apparatus of FIG. 26.
Figure 28:
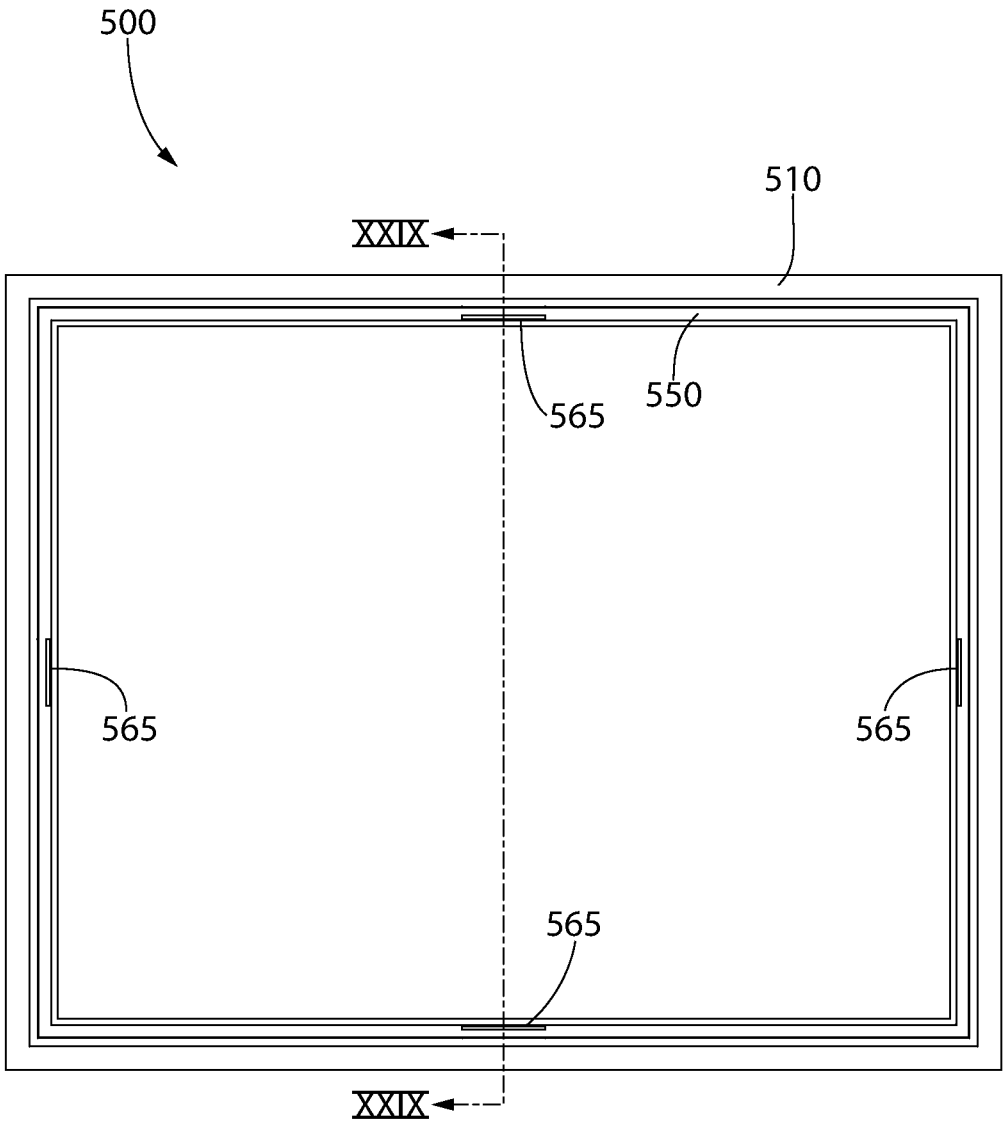
FIG. 28 is a rear view of the frame apparatus of FIG. 26.
Figure 29:
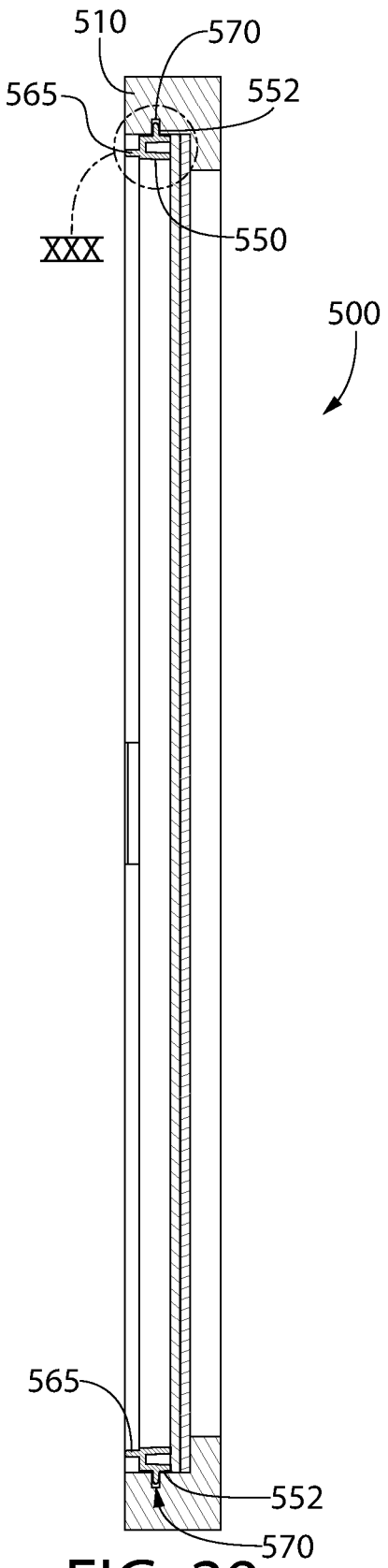
FIG. 29 is a cross-sectional view taken along line XXIX-XXIX of FIG. 28.
Figure 30:
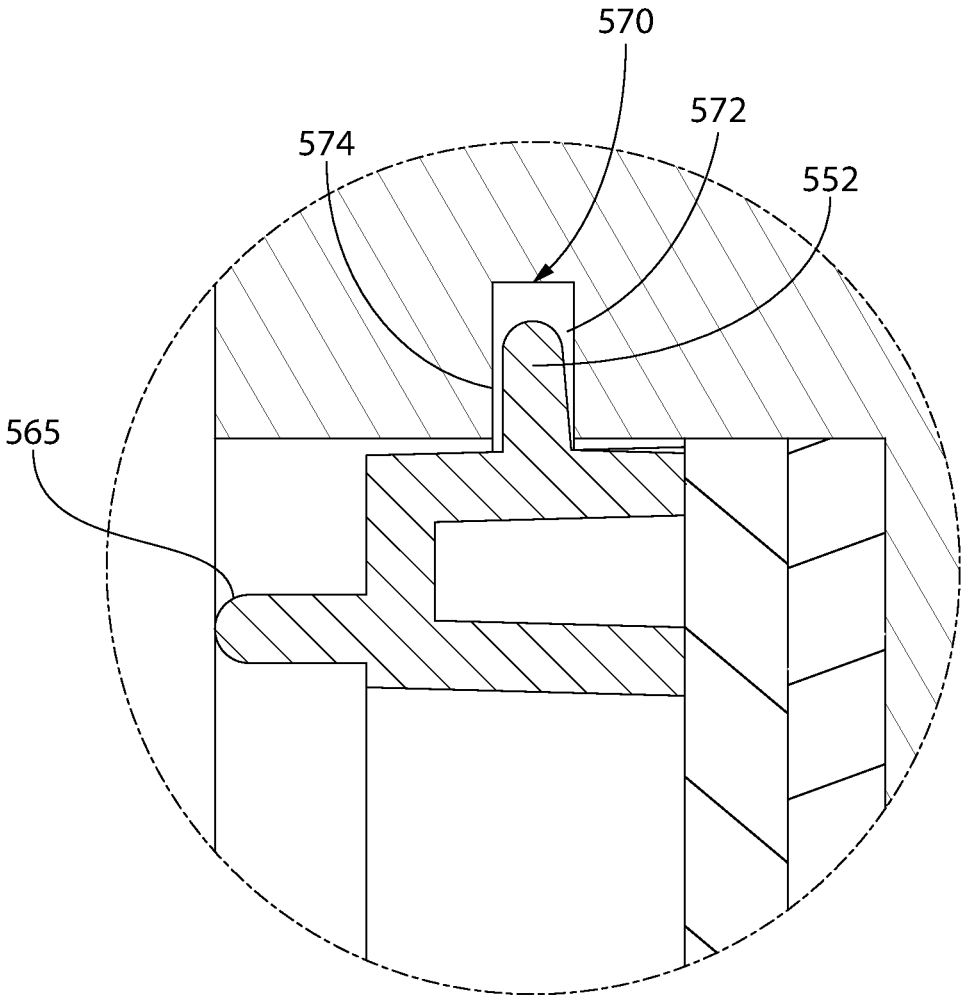
FIG. 30 is an enlarged view of area XXX of FIG. 29.
Figure 31:
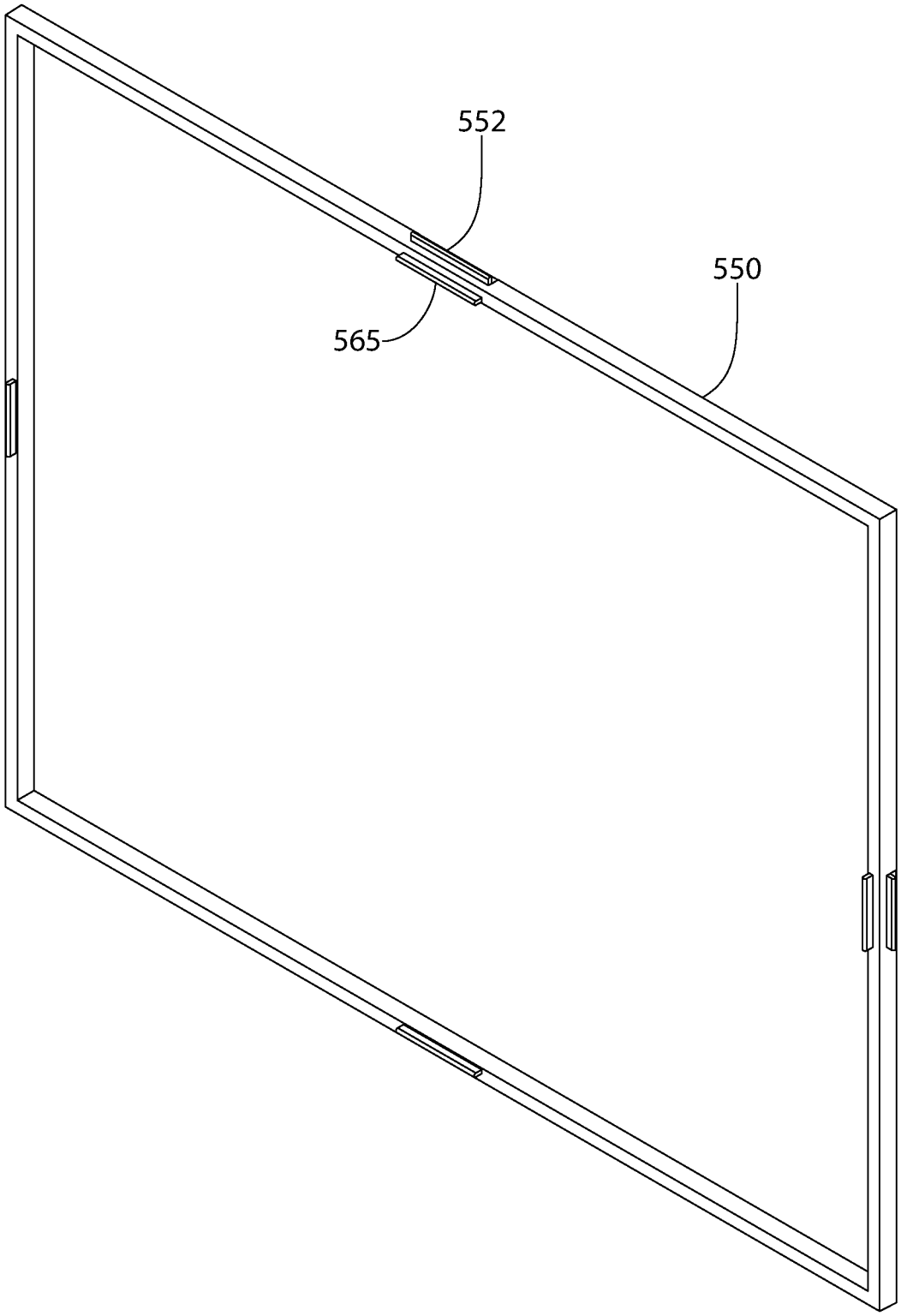
FIG. 31 is a rear perspective view of the annular spacer frame of FIG. 26.

Details of the construction of the annular display frame 310 are shown in greater detail in FIGS. 13-15. The two short sides 391, 392 and the two long sides 393, 394 are connected by a corner bracket 396. The corner bracket 396 may be crimped into place within the extrusion to form a strong connection and results in a very rigid annular display frame 310.

The annular spacer frame 350 is also constructed so that it has a first locking tab 352 and a second locking tab 354 provided on opposite elongate members. The annular spacer frame 350 is constructed in two pieces. In addition, the annular spacer frame has third locking tabs 355 located on perpendicular elongate members, such that all four sides engage the annular display frame 310.

The first, second, and third locking tabs 352, 354, 355 are curved so as to apply a spring pressure on the stack, and may deflect to accommodate differing thicknesses of display articles. The locking tabs 352, 354, 355 of this embodiment are identically formed, and have only a single first locking section 360 which engages the first engagement surface 374 of the engagement portion 370. The gripping elements 365 are integrally formed with the first locking section 360, such that a latch mechanism is formed in by the C-shaped curvature of the locking tabs 352, 354, 355 and the gripping elements 365, and no additional features are required to provide the user with a gripping area to engage or disengage the latch mechanism. This design also provides the necessary compression force, requiring no additional geometry. Individual engagement of each of the locking tabs 352, 354, 355 is possible due to the flexibility inherent in the C-shaped curvature.

Turning to FIGS. 20-25, a fourth embodiment of the frame apparatus 400 is shown. The present embodiment differs from the first embodiment in that it has a different design for the annular spacer frame 450. The annular spacer frame 450 has locking tabs 452 having a first locking section 460 which are formed with a straight profile. Furthermore, not all of the locking tabs 452 are identical, with some having a greater length than others. The first locking section 460 protrudes at a slight upward incline to pre-load the annular spacer frame 450 against the stack when assembled. The first locking section 460 may also incorporate ribs or other features designed to crush to enhance assembly. In other embodiments, there may be serrations designed to catch on the engagement portions 470 and permit adjustment of the desired compression. As with the frame apparatus 200, the locking tabs 452 are bordered by slots 469 which reduce the amount of force required to deflect the locking tabs 452 during installation. These may be omitted in alternate embodiments. In the present embodiment, six locking tabs 452 and six gripping elements 465 are used to ensure adequate pressure against the stack with a sufficiently even distribution to prevent movement of the display article.

In a fifth embodiment of the frame apparatus 500 as shown in FIGS. 26-31, the annular spacer frame 550 is constructed with four locking tabs 552 and four gripping elements 565. Further, there are no slots because the annular spacer frame 550 has been designed to permit deflection during installation without requiring excessive force. This embodiment is directed toward smaller frames that require fewer locking tabs 552 to apply even pressure to the stack. In some embodiments the number of locking tabs 552 and the number of gripping elements 565 may not be equal, and they may not be located proximate each other along the elongate members.

Of particular note, the annular display frame 510 has an engagement portion 570 which is formed a simple groove having only an entry section 572 having a first engagement surface 574. There is no locking section because it is not required to provide the desired level of retention and compression force. Furthermore, the annular display frame 510 is formed of a solid material rather than an extrusion.

Figure 32:
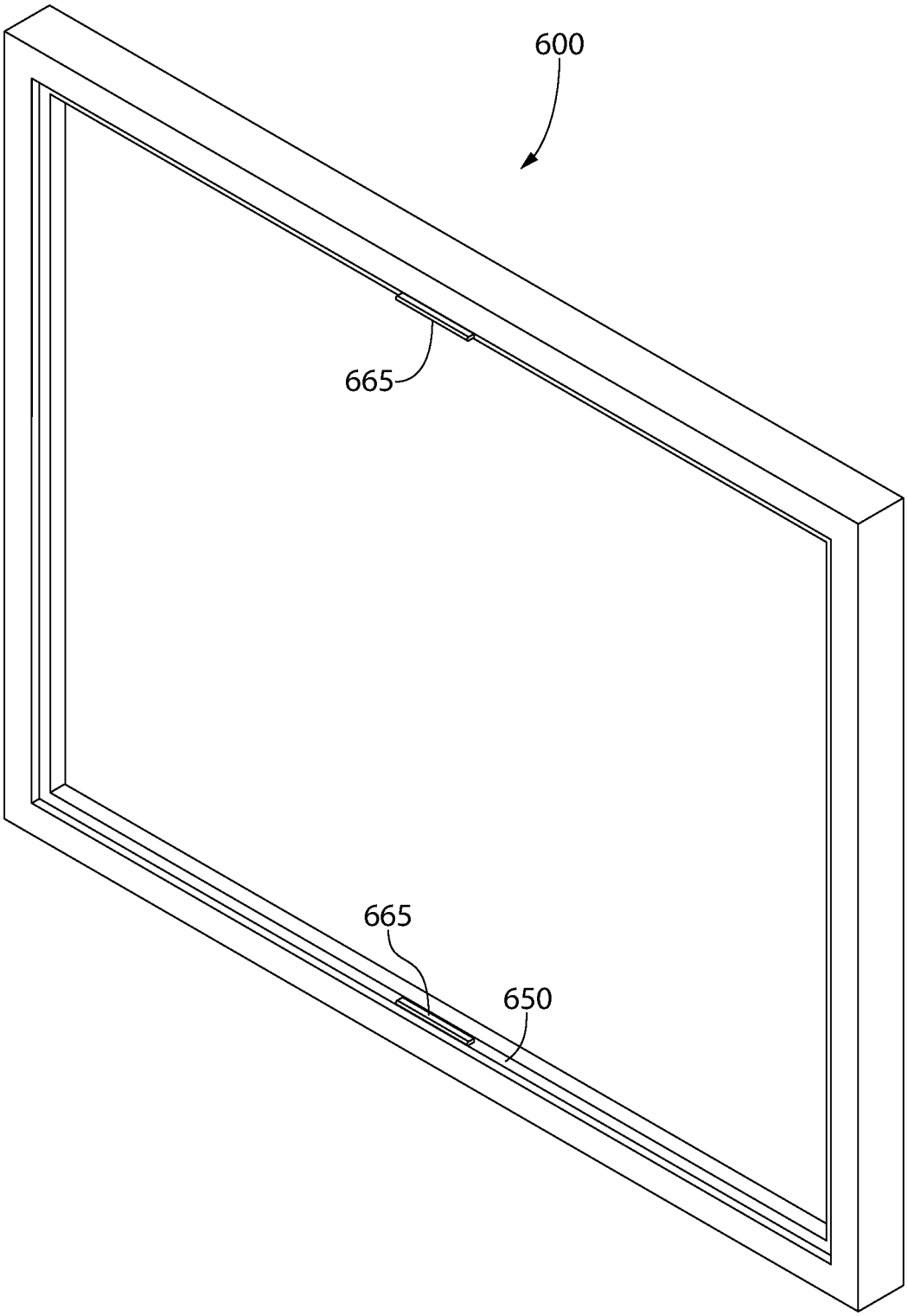
FIG. 32 is a rear perspective view of a frame apparatus according to a sixth embodiment of the present invention.
Figure 33:
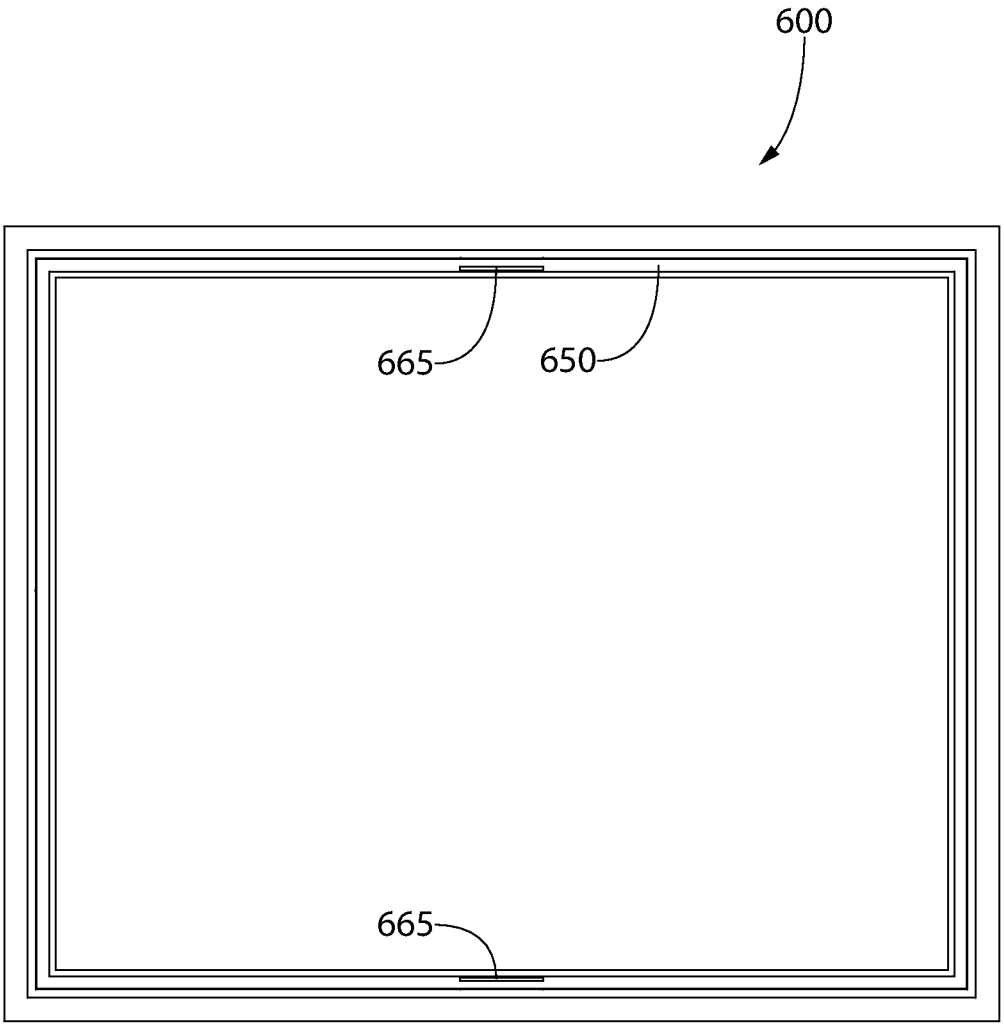
FIG. 33 is a rear view of the frame apparatus of FIG. 32.
Figure 34:
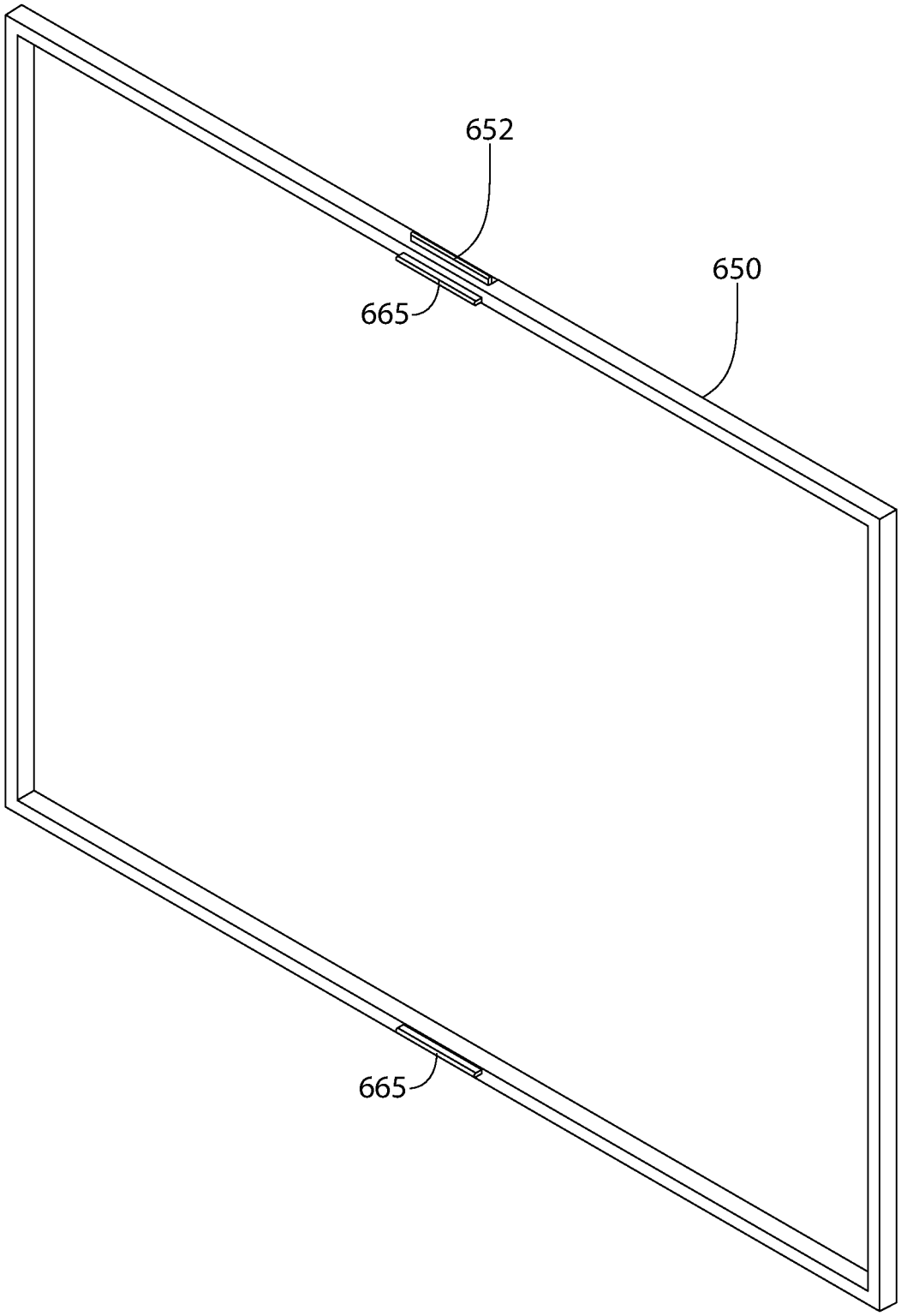
FIG. 34 is a rear perspective view of the annular spacer frame of FIG. 32.
Figure 35:
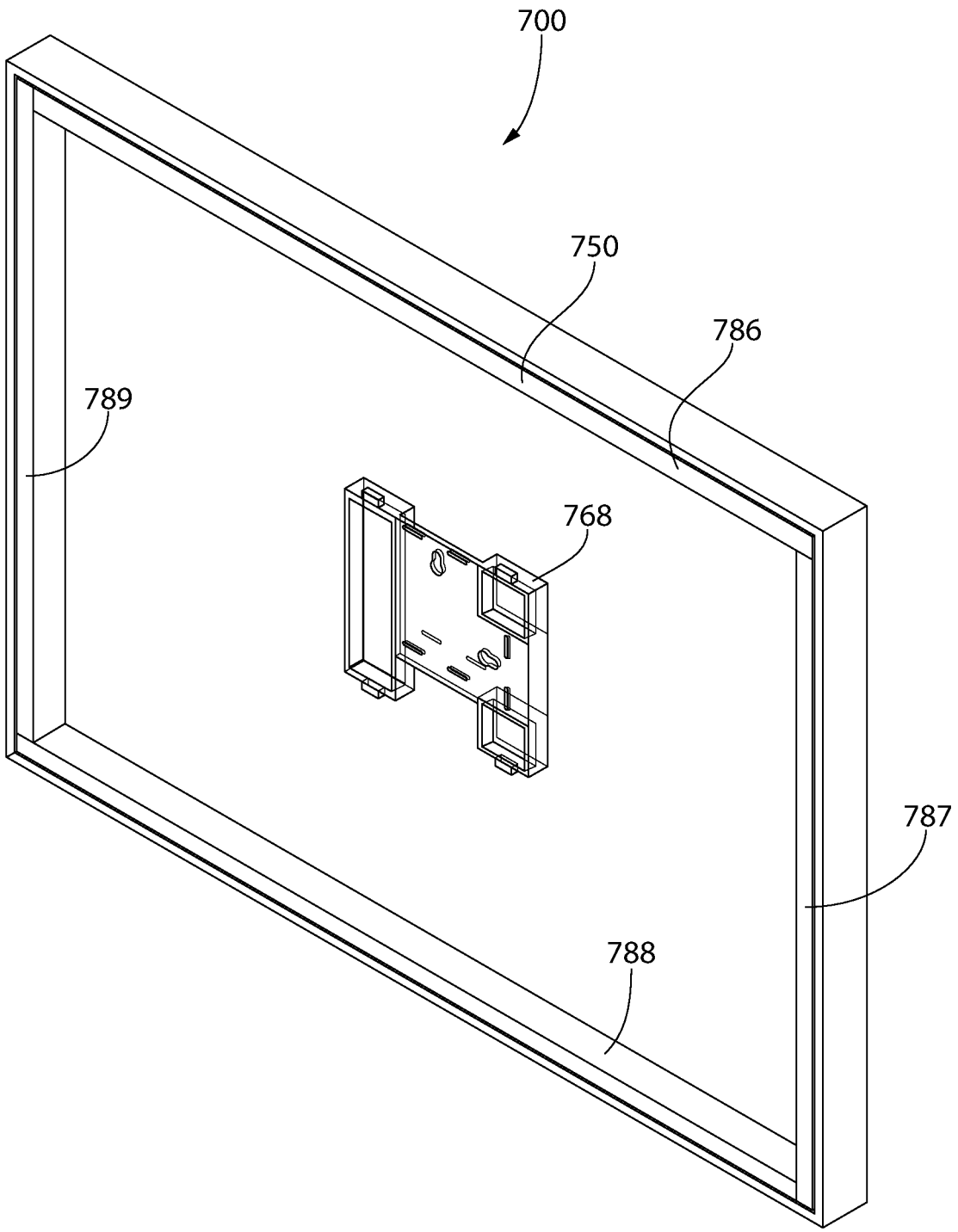
FIG. 35 is a rear perspective view of a frame apparatus according to a seventh embodiment of the present invention.
Figure 36:
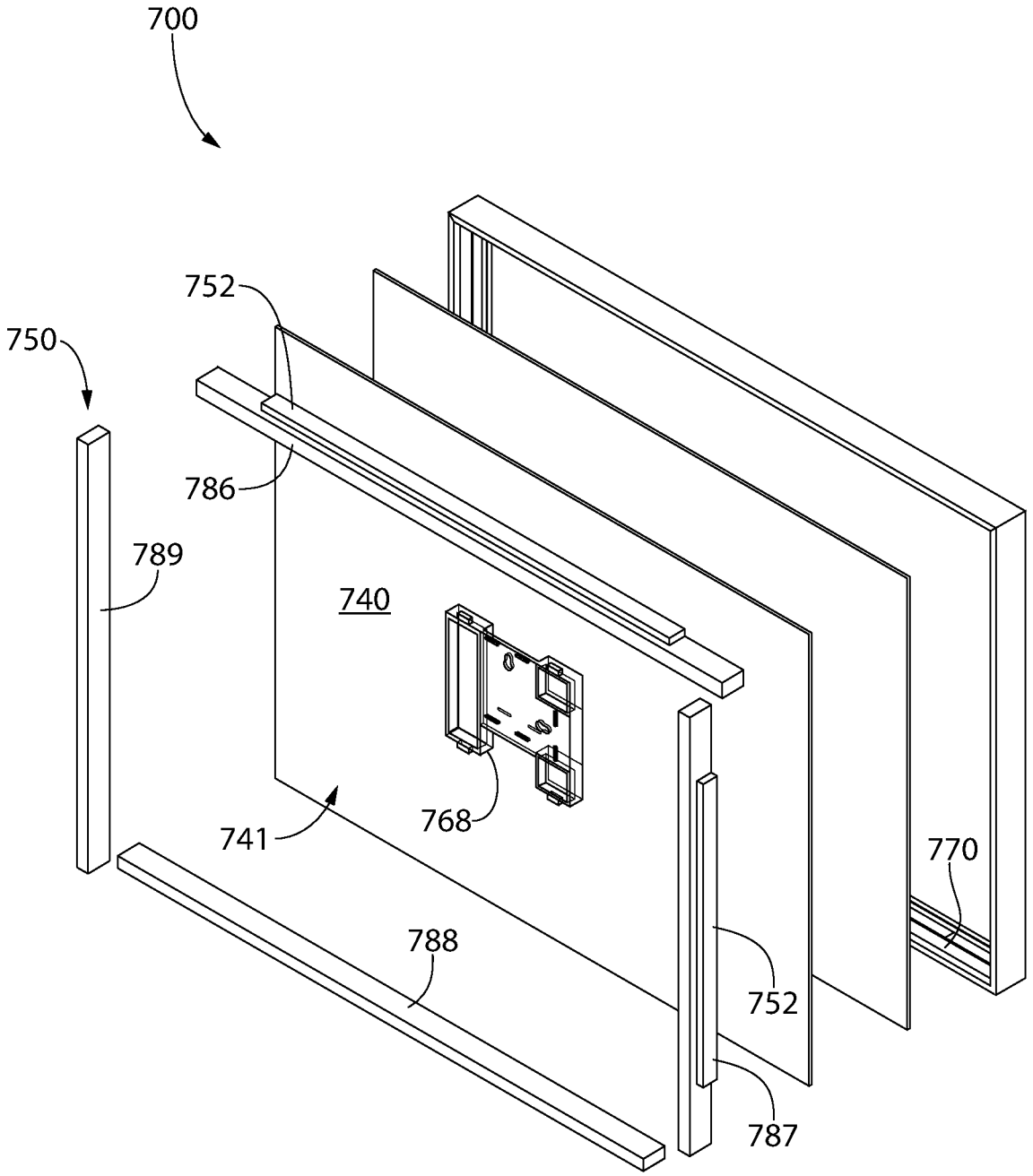
FIG. 36 is an exploded view of the frame apparatus of FIG. 35.
Figure 37:
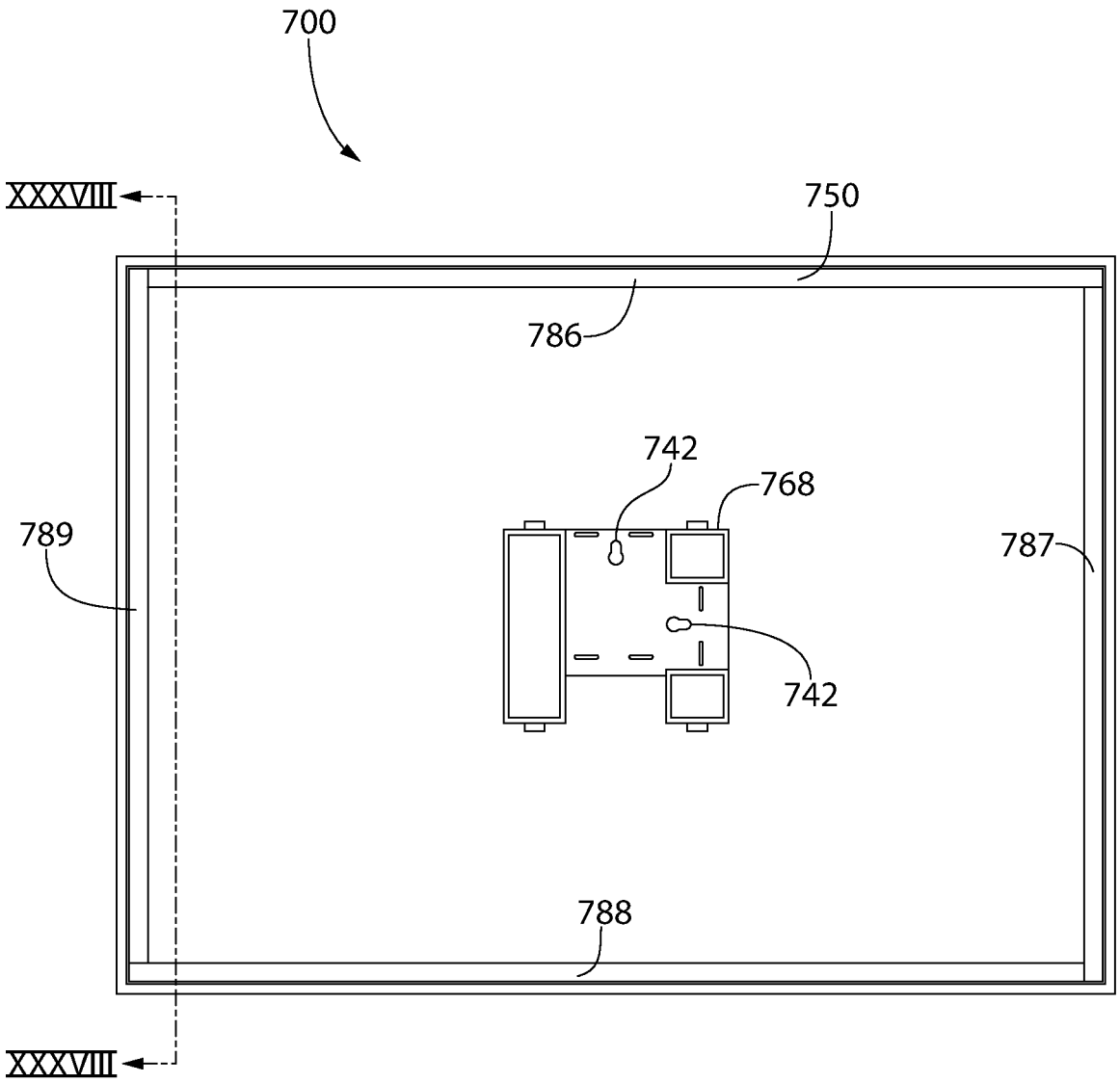
FIG. 37 is a rear view of the frame apparatus of FIG. 35.
Figure 38:
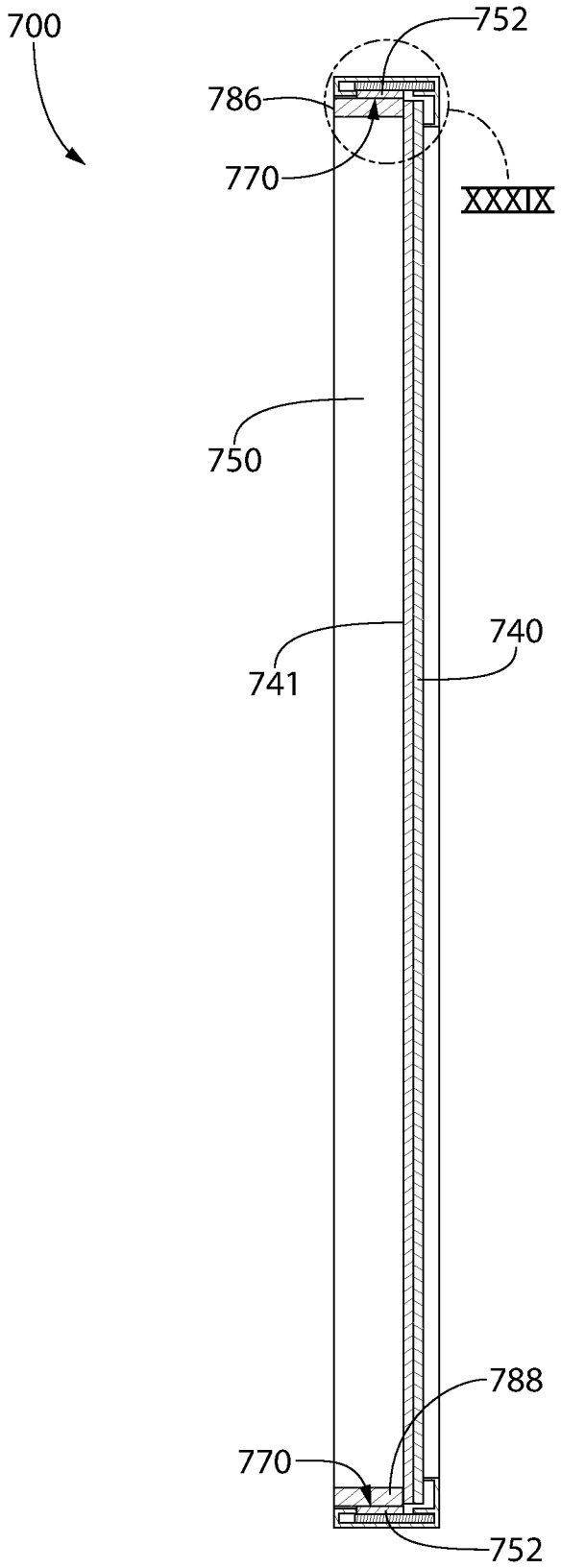
FIG. 38 is a cross-sectional view taken along line XXXVIII-XXXVIII of FIG. 37.
Figure 39:
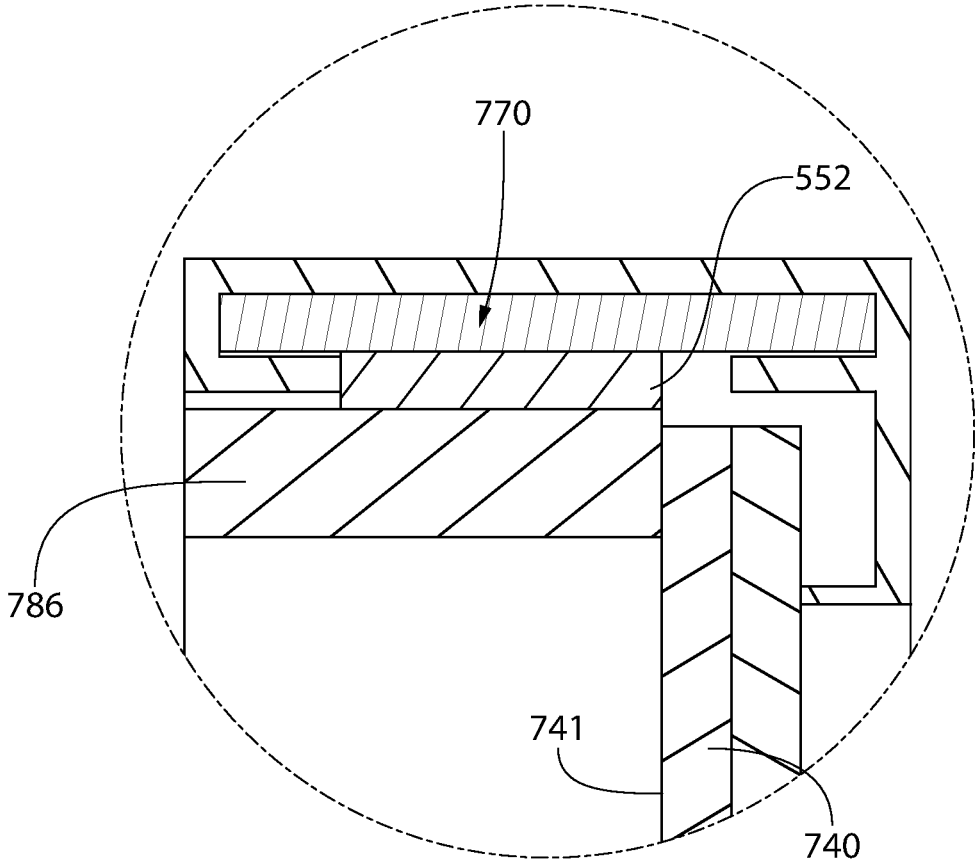
FIG. 39 is an enlarged view of area XXXIX of FIG. 38.
Figure 40:
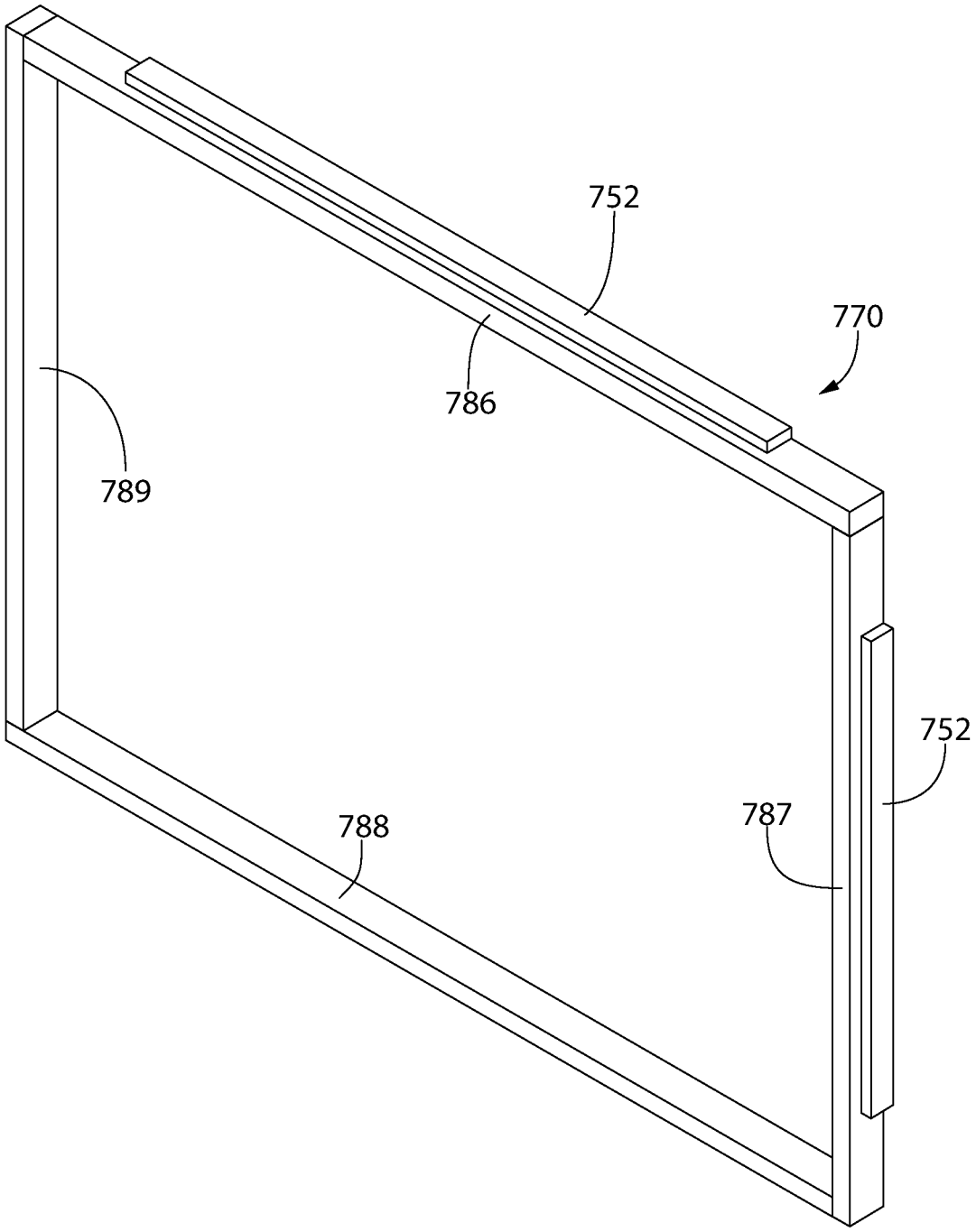
FIG. 40 is a rear perspective view of the annular spacer frame of FIG. 35.

Turning now to FIGS. 32-34, the frame apparatus 600 has an annular spacer frame 650 which has only two locking tabs 652 and two gripping elements 665.

FIGS. 35-39 show a seventh embodiment of the frame apparatus 700. The annular spacer frame 750 is composed of a first, second, third, and fourth spacer bar 786-789. The spacer bars 786-789 may be constructed of wood, MDF, or another rigid material, and may also have a second material applied thereto which has a lower elasticity such that is readily capable of compression. The second material serves as the locking tabs 752, applying pressure to the stack to retain the display article. The spacer bars 786-789 each have a locking tab 752 which holds the spacer bars 786-789 in place, engaging the engagement portions 770. The locking tabs 752 may be constructed of foam, and may be applied to the spacer bars 786-789 with adhesive, mechanical fasteners such as nails or staples, or other methods known in the art.

The rear panel 740 of the present embodiment differs from the rear panel of other embodiments because it incorporates a hanger element 768 attached to a rear face 741 of the rear panel 140. This hanger element 768 permits hanging of the frame apparatus 700, and is located near the center of the rear panel 740 so that it is covered by the article to be displayed when in use, preventing it from being seen in the event that the rear panel 740 is a transparent or translucent material. The hanger element 768 may be attached by ultrasonic welding, adhesive, integral molding, or the like. The hanger element 768 further incorporates mounting features 742 so that the frame apparatus 700 may be hung in a portrait orientation or a landscape orientation. In alternate embodiments, two or more mounting features 742 may be incorporated. Additional hanger elements may also be provided on the annular spacer frame 750.

Figure 41:
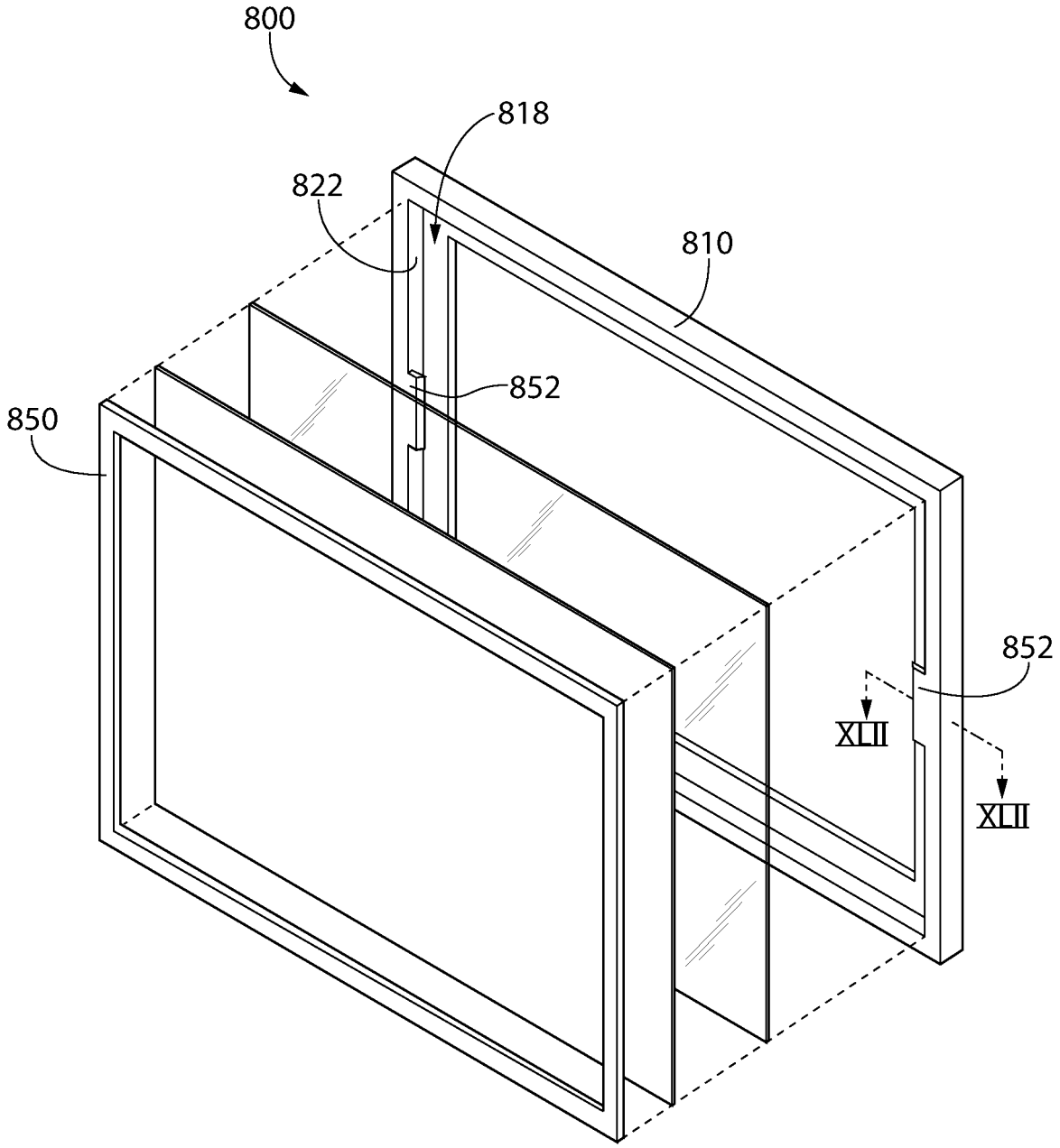
FIG. 41 is an exploded view of a frame apparatus according to an eighth embodiment of the present invention.
Figure 42:
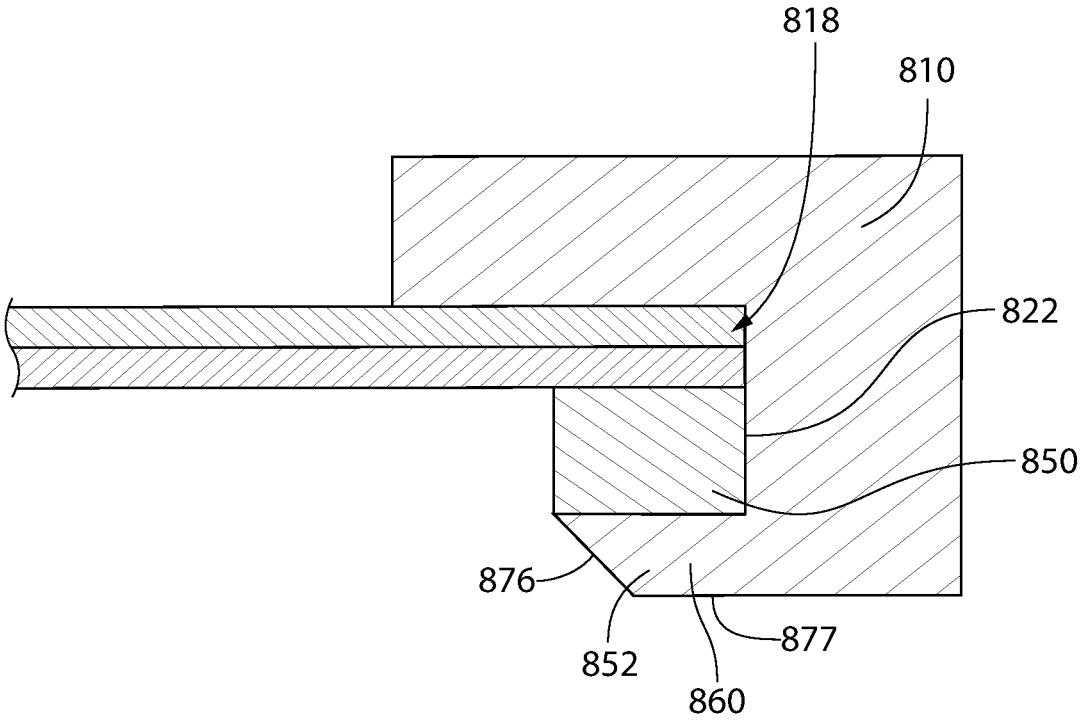
FIG. 42 is a cross-sectional view taken along line XLII-XLII of the frame apparatus of FIG. 41.

The embodiment of the frame apparatus 800 shown in FIGS. 41 and 42 is an alternate configuration for engaging the annular spacer frame 850 with the annular display frame 810. In this embodiment, the locking tabs 852 are provided on the annular display frame 810, and there is no engagement portion provided in the annular display frame 810. Effectively, the arrangement of the locking tabs 852 is reversed from the other embodiments. The annular spacer frame 850 may be constructed with any cross section which enables it to engage with the locking tabs 852. This may include a profile which is a continuous rectangular profile as shown in FIG. 42.

The locking tabs 852 protrude outward from the wall 822 of the rabbet 818. The locking tabs 852 are formed as a first locking section 860 having an insertion aid 876 formed on the top surface 877. The insertion aid 876 is designed to reduce the force required to insert the annular spacer frame 850. The annular spacer frame 850 is then captured underneath the locking tab 852 and compressed against the stack. The locking tabs 852 are designed to apply the required compression by design, and may extend outward from the wall 822 at any angle that is non-parallel with the wall 822. In some embodiments, the locking tabs 852 may be formed as a triangular protrusion, and may have additional features to increase the flexibility of the locking tabs 852 without compromising the rigidity of the annular display frame 810. In this embodiment, the annular spacer frame 850 still has a rigidity which is lower than the annular display frame 810, but in other embodiments it is contemplated that the annular spacer frame 850 may have a similar or greater rigidity, and may rely on the deflection of the locking tabs 852 alone to assemble the frame apparatus 800.

Figure 43:
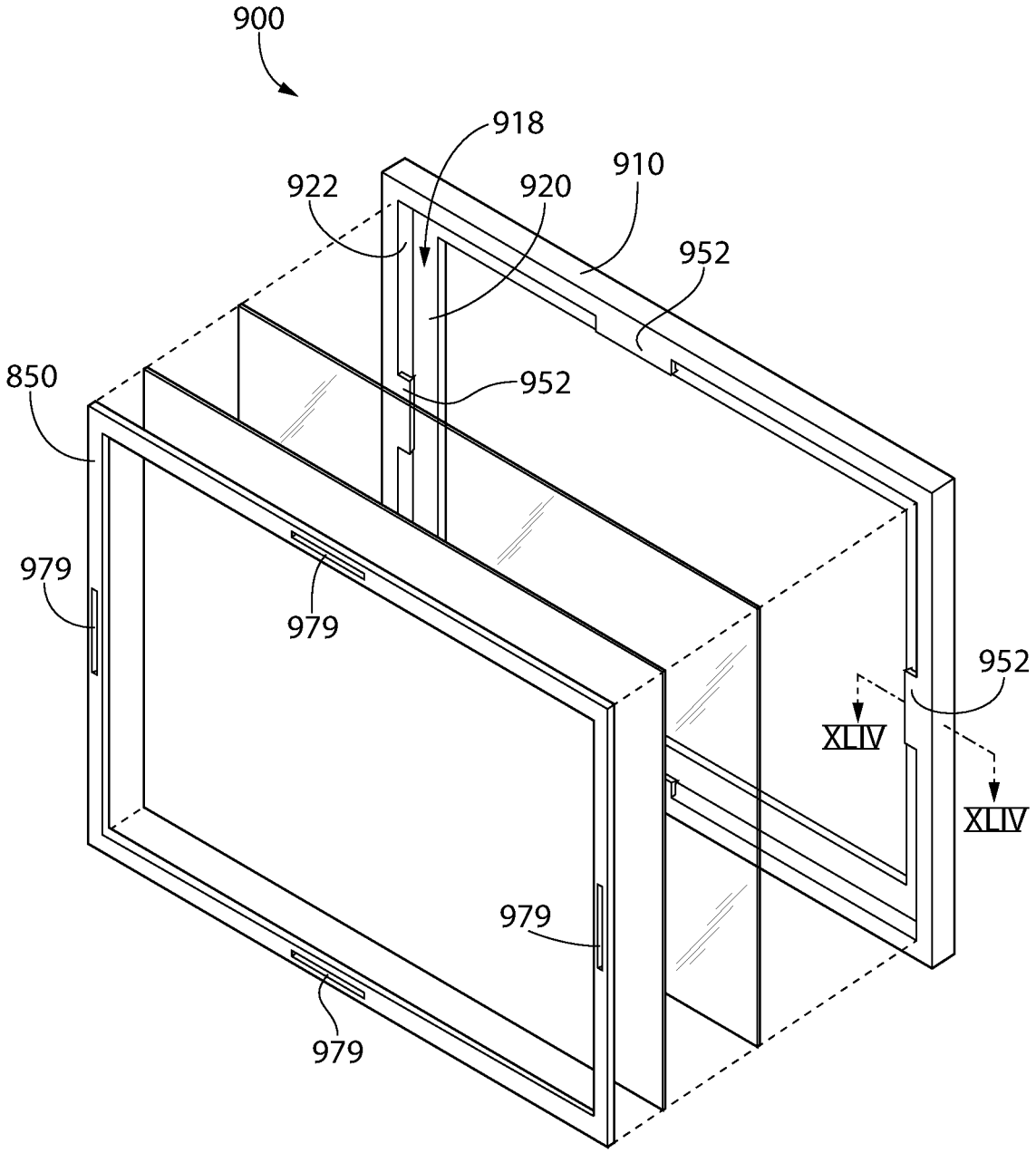
FIG. 43 is an exploded view of a frame apparatus according to a ninth embodiment of the present invention.
Figure 44:
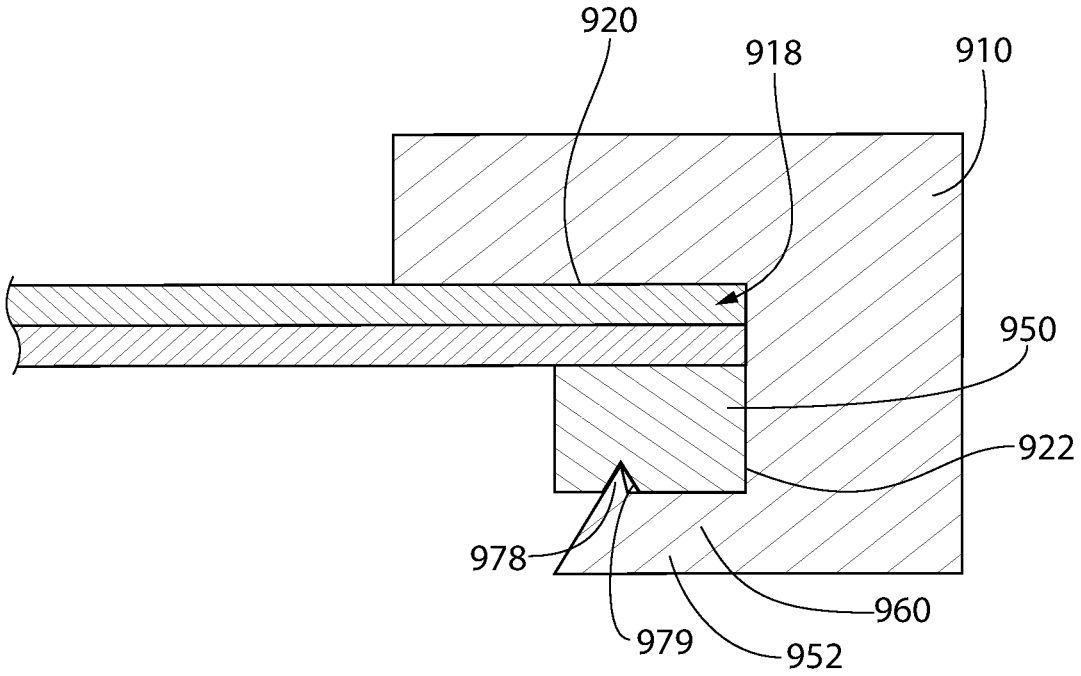
FIG. 44 is a cross-sectional view taken along line XLIV-XLIV of the frame apparatus of FIG. 43.

In a ninth embodiment of the invention shown in FIGS. 43 and 44, the frame apparatus 900 has locking tabs 952 which protrude from the annular display frame 910. As with the frame apparatus 800, the annular spacer frame 950 does not have locking tabs or other engagement feature, and is substantially constructed as a continuous profile. The locking tabs 952 have a first locking section 960 extending in a non-parallel direction from the wall 922 of the rabbet 918. The locking tabs 952 further have a retention feature 978 which extends downward toward the floor 920 of the rabbet 918. These retention features 978 engage v-shaped receiving features 979 formed on the annular spacer frame 950. The retention features 978 and the receiving features 979 interlock to further enhance the retention of the annular spacer frame 950 and maintain the desired compression on the stack, preventing movement of the display article.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A frame apparatus for displaying an article, the frame apparatus comprising:

an annular display frame having an inner surface defining a display opening, the annular display frame comprising:

a rabbet defined by a floor and a wall of the annular display frame; and a channel formed into the wall;

a stack positioned in the rabbet;

a plurality of spacer bars positioned in the rabbet, each of the spacer bars comprising a rigid portion and a compressible portion, the compressible portion extending into the channel in the wall of the rabbet to couple the spacer bars to the annular display frame and hold the stack in the rabbet; and wherein the compressible portion comprises foam.

2. The frame apparatus according to claim 1 wherein the stack is sandwiched between the rigid portion of the spacer bars and the floor of the rabbet.

3. The frame apparatus according to claim 1 wherein the annular display frame is constructed from extrusions of aluminum, steel, or polyvinyl chloride.

4. The frame apparatus according to claim 1 wherein the rigid portion comprises wood or fiberboard.

5. The frame apparatus according to claim 1 wherein each of the spacer bars is elongated along an axis, and wherein for each of the spacer bars the rigid portion has a first length measured in a direction of the axis and the compressible portion has a second length measured in the direction of the axis, the first length being greater than the second length.

6. The frame apparatus according to claim 1 wherein the rigid portion of each of the spacer bars has an outer surface that faces an inner surface of the wall of the rabbet of the annular display frame and an inner surface opposite the outer surface, and wherein the compressible material is coupled to and extends from the outer surface of the rigid portion.

7. The frame apparatus according to claim 1 wherein each of the spacer bars has a lower surface that contacts the stack and an upper surface opposite the lower surface, and wherein the upper surface of the spacer bars is substantially flush with a rear surface of the annular spacer frame.

8. The frame apparatus according to claim 1 wherein a front surface of the stack is in contact with the floor of the rabbet and a lower surface of the spacer bars is in contact with a rear surface of the stack to hold the stack in the rabbet.

9. The frame apparatus according to claim 1 wherein the stack comprises a rear panel having an exposed rear surface, and further comprising a hanger component coupled to the rear surface of the rear panel, the hanger component comprising mounting features configured for hanging the frame apparatus from a wall in a portrait or landscape orientation.

10. The frame apparatus according to claim 9 wherein the hanger component is located near a center of the rear panel.

11. The frame apparatus according to claim 9 wherein the hanger component is welded to the rear surface of the rear panel.

12. The frame apparatus according to claim 1 wherein the rigid portion of each of the spacer bars comprises a lower surface that is in contact with the stack, an upper surface that does not protrude beyond a rear surface of the annular display frame, an inner surface, and an outer surface that faces the wall of the rabbet, and wherein the compressible portion of each of the spacer bars is located on the outer surface of the rigid portion.

13. The frame apparatus according to claim 12 wherein the compressible portion of each of the spacer bars comprises a lower surface that is flush with the lower surface of the rigid portion and an upper surface that is spaced apart from the upper surface of the rigid portion such that the rigid portion has a first width measured between the lower and upper surfaces of the rigid portion that is greater than a second width of the compressible portion measured between the lower and upper surfaces of the compressible portion.

14. The frame apparatus according to claim 13 wherein the rigid portion of each of the spacer bars extends from a first end to a second end and the compressible portion of each of the spacer bars extends from a first end to a second end, and wherein for each of the spacer bars the rigid portion has a first length measured between the first and second ends of the rigid portion that is greater than a second length of the compressible portion measured between the first and second ends of the compressible portion.

15. A frame apparatus for displaying an article, the frame apparatus comprising:

an annular display frame having an inner surface defining a display opening, the annular display frame comprising:

a rabbet defined by a floor and a wall of the annular display frame; and a channel formed into the wall;

a stack positioned in the rabbet;

a plurality of spacer bars positioned in the rabbet, each of the spacer bars comprising a rigid portion and a compressible portion, the compressible portion extending into the channel in the wall of the rabbet to couple the spacer bars to the annular display frame and hold the stack in the rabbet; and wherein each of the spacer bars extends from a first end to a second end along an axis, and wherein the first end of each of the spacer bars abuts an inner surface of the wall of the rabbet of the annular display frame and the second end of each of the spacer bars abuts a portion of an inner surface of another one of the spacer bars.

16. A frame apparatus for displaying an article, the frame apparatus comprising:

an annular display frame having an inner surface defining a display opening, the annular display frame comprising:

a rabbet defined by a floor and a wall of the annular display frame; and a channel formed into the wall;

a stack positioned in the rabbet; and a spacer assembly positioned in the rabbet in contact with the stack, the spacer assembly comprising a first portion formed of a rigid material and a second portion formed of a compressible material, the compressible material of the second portion extending into the channel in the wall of the rabbet to couple the spacer assembly to the annular display frame and hold the stack in the rabbet.

17. The frame apparatus according to claim 16 wherein the compressible material comprises foam.

18. The frame apparatus according to claim 17 wherein the rigid material comprises wood or fiberboard.

19. The frame apparatus according to claim 16 wherein the spacer assembly comprises a plurality of spacer bars, each of the spacer bars extending from a first end to a second end along an axis, and wherein the first portion and the second portion of each of the spacer bars is elongated along the axis.

20. The frame apparatus according to claim 19 wherein the first end of each of the spacer bars abuts an inner surface of the wall of the rabbet of the annular display frame and the second end of each of the spacer bars abuts a portion of an inner surface of another one of the spacer bars.

* * * * *